US008160870B2

(12) United States Patent
Moriya et al.

(10) Patent No.: US 8,160,870 B2
(45) Date of Patent: Apr. 17, 2012

(54) METHOD, APPARATUS, PROGRAM, AND RECORDING MEDIUM FOR LONG-TERM PREDICTION CODING AND LONG-TERM PREDICTION DECODING

(75) Inventors: Takehiro Moriya, Nerima-ku (JP); Noboru Harada, Nerima-ku (JP); Yutaka Kamamoto, Bunkyo-ku (JP); Takuya Nishimoto, Bunkyo-ku (JP); Shigeki Sagayama, Bunkyo-ku (JP)

(73) Assignees: Nippon Telegraph and Telephone Corporation, Tokyo (JP); The University of Tokyo, Tokyo (JP)

( * ) Notice: Subject to any disclaimer, the term of this patent is extended or adjusted under 35 U.S.C. 154(b) by 0 days.

(21) Appl. No.: 13/049,442

(22) Filed: Mar. 16, 2011

(65) Prior Publication Data

US 2011/0166854 A1 Jul. 7, 2011

Related U.S. Application Data

(62) Division of application No. 11/793,821, filed as application No. PCT/JP2006/300194 on Jan. 11, 2006, now Pat. No. 7,970,605.

(30) Foreign Application Priority Data

Jan. 12, 2005 (JP) ..... 2005-004915

(51) Int. Cl.
*G10L 19/04* (2006.01)

(52) U.S. Cl. ..... 704/219

(58) Field of Classification Search ..... 704/219
See application file for complete search history.

(56) References Cited

U.S. PATENT DOCUMENTS

| | | | | |
|---|---|---|---|---|
| 5,729,655 | A | 3/1998 | Kolesnik et al. | |
| 6,271,885 | B2 | 8/2001 | Sugiyama | |
| 7,225,136 | B2 | 5/2007 | Bruekers et al. | |
| 7,599,835 | B2 * | 10/2009 | Moriya et al. | 704/226 |
| 7,970,605 | B2 * | 6/2011 | Moriya et al. | 704/219 |

FOREIGN PATENT DOCUMENTS

| | | |
|---|---|---|
| JP | 61-177822 | 8/1986 |
| JP | 3-123113 | 5/1991 |
| JP | 3 171830 | 7/1991 |
| JP | 4 70800 | 3/1992 |
| JP | 5 35297 | 2/1993 |

(Continued)

OTHER PUBLICATIONS

Extended European Search Report issued Jan. 27, 2011, in European Patent Application No. 10195915.3.

(Continued)

*Primary Examiner* — Susan McFadden
(74) *Attorney, Agent, or Firm* — Oblon, Spivak, McClelland, Maier & Neustadt, L.L.P.

(57) ABSTRACT

A method and apparatus multiplies a past sample a time lag $\tau$ older than a current sample by a quantized multiplier $\rho'$ on a frame by frame basis, subtracts the multiplication result from the current sample, codes the subtraction result, and codes the time lag using a fixed-length coder if the multiplier $\rho'$ is smaller than 0.2 or if information about the previous frame is unavailable, or codes the time lag using a variable-length coder if $\rho'$ is not smaller than 0.2. A multiplier $\rho$ is coded by a multiplier coder and the multiplier $\rho'$ obtained by decoding the multiplier $\rho$ is outputted. The process is performed for each frame.

8 Claims, 17 Drawing Sheets

FOREIGN PATENT DOCUMENTS

| | | |
|---|---|---|
| JP | 5 119800 | 5/1993 |
| JP | 7-168597 | 7/1995 |
| JP | 8 123492 | 5/1996 |
| JP | 2000 22545 | 1/2000 |
| JP | 2000-235399 | 8/2000 |
| JP | 3218630 | 8/2001 |

OTHER PUBLICATIONS

Tilman Liebchen, et al., "MPEG-4 ALS: An Emerging Standard for Lossless Audio Coding", Data Compression Conference, Mar. 23, 2004, XP010692571, pp. 439-448.

* cited by examiner

METHOD, APPARATUS, PROGRAM, AND RECORDING MEDIUM FOR LONG-TERM PREDICTION CODING AND LONG-TERM PREDICTION DECODING

CROSS-REFERENCED TO RELATED APPLICATIONS

This application is a divisional application of U.S. Ser. No. 11/793,821 filed Jun. 22, 2007, the entire contents of which are incorporated in its entirety herein by reference. U.S. Ser. No. 11/793,821 is a National Stage of PCT JP06/300194 filed Jan. 11, 2006, and claims the benefit of priority under 35 U.S.C. §119 of Japanese Application No. 2005-004915 filed Jan. 12, 2005.

TECHNICAL FIELD

The present invention relates to a method, apparatus, program, and recording medium for coding a time-series speech signal by compressing the signal into a smaller number of bits using long-term prediction coefficients, i.e., a pitch period (time lag) $\tau$ and gain $\rho$, of the time-series signal, and a method, apparatus, program, and recording medium for decoding. More particularly, the present invention relates to a technique for lossless coding.

BACKGROUND ART

Coding of telephone speech signals uses the long-term prediction to predict similarity of waveforms among pitch periods. Since it is highly likely that coding of telephone speech signals is used in wireless communications and the like, codes of a fixed length are used for coding of pitch prediction parameters $\tau$ and $\rho$. In lossless coding of audio signals, a method for making predictions using a correlation between efficiency coding apparatus and high efficiency decoding apparatus and again, fixed-length coding is used for coding of a multiplier $\rho$ and time lag parameter $\tau$.
Patent literature: Japanese Patent No. 3218630

DISCLOSURE OF THE INVENTION

Problem to be Solved by the Invention

In the conventional speech signal coding, long-term prediction coefficients, i.e., a pitch period (time lag) $\tau$ and gain (multiplier) $\rho$, are coded into fixed length codes, and consequently there are limits to improvement of compression efficiency.

An object of the present invention is to provide a long-term prediction coding method which can improve compression efficiency over the conventional speech signal coding methods as well as to provide a long-term prediction coding apparatus, long-term prediction decoding method, and long-term prediction decoding apparatus.

Means to Solve the Problems

A long-term prediction coding method according to the present invention comprises:

(a) a step of obtaining an error signal sample by subtracting from a current sample of an input sample time-series signal a multiplication result obtained by multiplying a past sample which is a predetermined time lag older than the current sample of the input sample time-series signal, by a multiplier;

(b) a step of obtaining a first code by coding a series of the error signal samples;

(c) a step of obtaining a second code and a third code by coding the time lag and the multiplier, respectively; and (d) a step of outputting the first code, the second code and the third code, wherein the step (c) includes a step of variable-length coding at least one of the time lag and the multiplier.

A long-term prediction decoding method according to the present invention comprises:

(a) a step of decoding an error signal from a first code in an input code;

(b) a step of decoding a time lag and a multiplier from a second code and a third code in the input code, respectively; and (c) a step of reconstructing a time-series signal by adding a current sample of the error signal to a multiplication result obtained by multiplying a past sample of the error signal which is the time lag older, by the multiplier, wherein the step (b) includes a step of decoding at least one of the time lag and the multiplier with reference to a code table of variable-length codewords.

A long-term prediction coding apparatus according to the present invention comprises:

a multiplying part for multiplying a past sample which is a predetermined time lag older than a current sample of an input sample time-series signal, by a multiplier;

a subtractor for subtracting an output of the multiplying part from the current sample and thereby outputting an error signal;

a waveform coder for coding the error signal and thereby obtaining a first code;

an auxiliary information coder for coding the time lag and the multiplier and thereby outputting a second code and a third code, wherein said auxiliary information coder includes a variable-length coder for variable-length coding at least one of the time lag and the multiplier.

A long-term prediction decoding apparatus according to the present invention comprises:

a waveform decoder for decoding a first waveform code in an input code and thereby outputting an error signal;

an auxiliary information decoder for decoding a second and a third code in the input code to obtain a time lag and a multiplier respectively;

a multiplying part for multiplying a past sample of the error signal which is the time lag older, by the multiplier; and an adder for adding an output of the multiplying part to a current sample of the error signal, and thereby reconstructing a time-series signal;

wherein the auxiliary information decoder includes a variable-length decoder which decodes at least one of the second code and the third code with reference to a code table of variable-length codewords.

Effects of the Invention

Values of auxiliary information such as time lag $\tau$ and multiplier $\rho$ used in long-term prediction coding sometimes occur at biased frequencies. In case of such biased occurrence frequencies, the present invention, which variable-length encodes the auxiliary information into variable-length codes, can increase coding efficiency.

BEST MODES FOR CARRYING OUT THE INVENTION

First Embodiment

Coding Side

Figure 1:
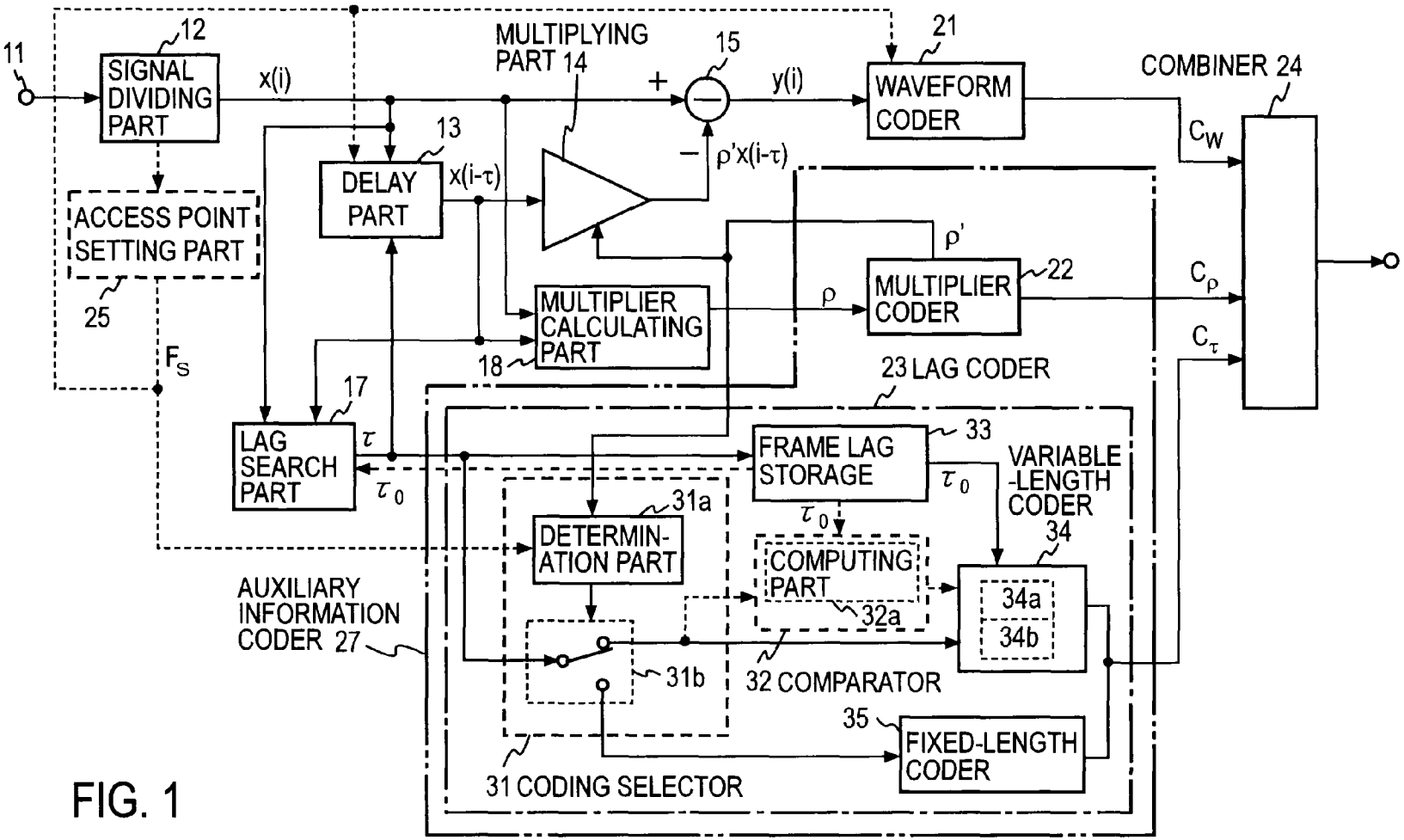
FIG. 1 is a block diagram showing a functional configuration example of a coding apparatus according to a first embodiment.
Figure 2:
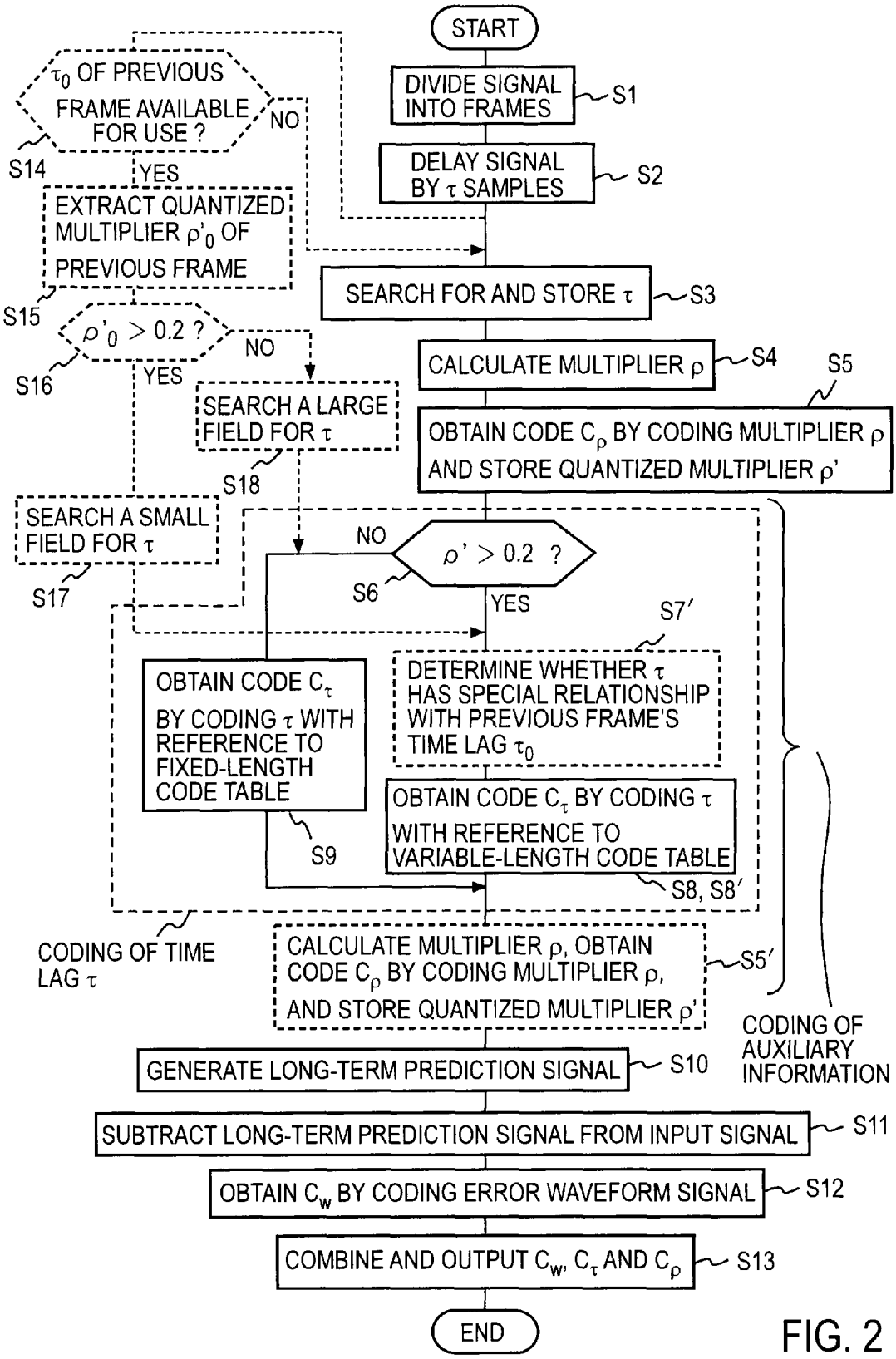
FIG. 2 is a flowchart showing an exemplary processing procedure of the apparatus shown in FIG. 1.

Embodiments of the present invention will be described below with reference to the drawings, in which like components will be denoted by the same reference numerals and redundant description thereof will be omitted. FIG. 1 shows an example of a functional configuration of a coding apparatus according to a first embodiment and FIG. 2 shows a processing procedure of the coding apparatus.

Before describing the present invention concretely, a long-term prediction coding method will be described briefly. An input terminal 11 in FIG. 1 is fed with a time-series signal of digital samples obtained by sampling a signal waveform periodically. The time-series signal of the samples is divided into predetermined intervals (known as frames), for example, into processing units consisting of 1024 to 8192 samples each by a signal dividing part 12 (Step S1). A time-series signal x(i) (where i is a sample number) from the signal dividing part 12 is delayed by $\tau$ samples (the amount of delay is denoted by $Z_\tau$) by a delay part 13 and outputted as a signal $x(i-\tau)$ (Step S2). A multiplying part 14 multiplies the output of the delay part 13, i.e., a sample $x(i-\tau)$ (also called a sample with a time lag $\tau$), which is $\tau$ samples older than the current sample by a quantized multiplier $\rho'$. The result of multiplication is subtracted as a long-term prediction signal from the current sample x(i) by a subtractor 15 to obtain an error signal y(i).

Normally, $\tau$ and $\rho'$ are determined from an auto-correlation function of the time-series signal to be coded. Letting x(i) be the time-series signal to be coded, the number of samples in a frame be N, a vector of the time-series signal x(i) of the frame be $X=(x(0), \ldots, x(N-1))$, and a vector corresponding to the vector X delayed $\tau$ samples be given by $X_\tau=(x(-\tau), \ldots, x(N-1-\tau))$, then all that is necessary is to determine $\tau$ which minimizes the following distortion d.

$$d=|X-\rho X_\tau|^2 \tag{1}$$

For that, first, Eq. (1) is partially differentiated with respect to $\rho$, the resulting equation is set to zero, obtaining the following equation.

$$\rho=X_\tau^T X/X_\tau^T X_\tau \tag{2}$$

where $X_\tau^T X$ and $X_\tau^T X_\tau$ are inner products, which can be determined using the following equations.

$$X_\tau^T X=\sum_{i=0}^{N-1} x(i-\tau)x(i) \tag{3}$$

$$X_\tau^T X_\tau=\sum_{i=0}^{N-1} x(i-\tau)^2 \tag{4}$$

Next, by substituting Eq. (2) into Eq. (1), the following equation is obtained.

$$d=|X|^2-(X_\tau^T X)^2/|X_\tau|^2 \tag{5}$$

From Eq. (5), it can be seen that to minimize the distortion d, all that is necessary is to find $\tau$ which maximizes $(X_\tau^T X)^2/$ $|X_\tau|^2$ by varying $\tau$ in a preset search range. The time lag $\tau$ obtained corresponds to a pitch period.

Figure 3:
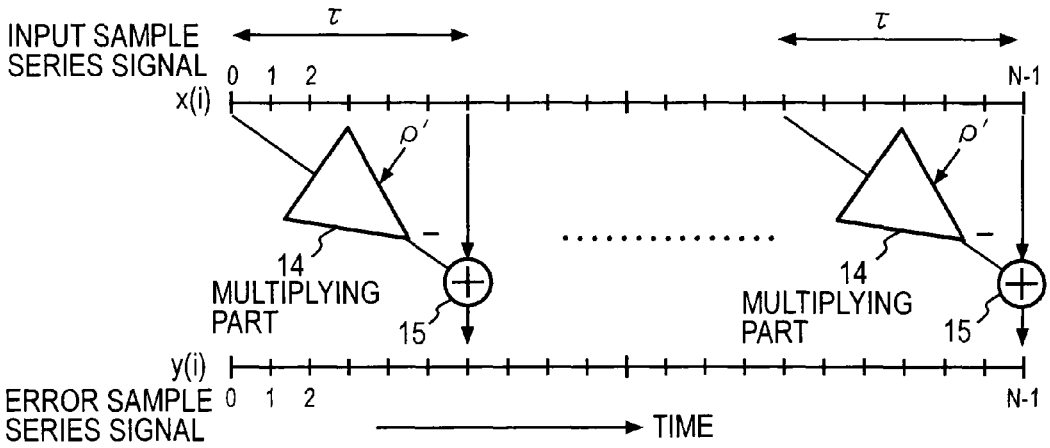
FIG. 3 is a diagram briefly showing a relationship between input and output of long-term prediction coding.

FIG. 3 shows a relationship, on a time axis, between the input sample series signal x(i) and the error signal $y(i)=x(i)-\Sigma' x(i-\tau)$ from the subtractor 15. Returning to FIG. 1, the vector X (input sample series signal) and the vector $X_\tau$ delayed $\tau$ samples from the vector X by the delay part 13 are inputted to a lag search part 17, which then searches for $\tau$ which maximizes $(X_\tau^T X)^2/|X_\tau|^2$ (Step S3). A range of this search may be preset, for example, to sample points 256 to 511. Alternatively, a search range of, for example, $\tau_0-200 \leqq \tau \leqq \tau_0+200$ may be preset and a practical search range may be changed on a frame by frame basis according to the time lag $\tau$ of the previous frame (hereinafter referred to as the previous frame's time lag $\tau_0$). In that case, the previous frame's time lag $\tau_0$ stored in a frame lag storage 33 is given to the lag search part 17. The retrieved $\tau$ is stored as $\tau_0$ in the frame lag storage 33 for use in the coding of the time lag $\tau$ of the next frame. Also, the multiplier $\rho$ is calculated by a multiplier calculating part 18 from the vector X and the vector $X_\tau$ delayed $\tau$ samples using Eq. (2) (Step S4).

When $(X_\tau^T X)^2/|X_\tau|^2$ is maximized, available values for the multiplier $\rho$ given by Eq. (2) is in the range $-1 \leqq \rho \leqq 1$. Normally, the multiplier $\rho$ often assumes a positive value although it can assume a negative value.

A signal of error sample sequence from the subtractor 15 is reversibly coded by a waveform coder 21 using inter-frame prediction coding. Consequently, a code $C_W$ is outputted. If the overall coding does not need to be reversible, the error sample sequence signal may be coded irreversibly. Also, the multiplier $\rho$ is encoded into a code $C_\rho$ by a multiplier coder 22 and the time lag $\tau$ is encoded into a code $C_\tau$ by a lag coder 23. The multiplier coder 22 and lag coder 23 compose an auxiliary information coder 27. A combiner 24 combines the code $C_\rho$ and code $C_\tau$ as auxiliary codes with the code $C_W$ and outputs a resulting code on a frame by frame basis. Incidentally, the quantized multiplier $\rho'$ decoded from the code $C_\rho$ by the multiplier coder 22 is supplied to the multiplying part 14 and used there for multiplication of $X_\tau$.

Conventionally, the auxiliary codes $C_\rho$ and $C_\tau$ are fixed-length codes which have a fixed code length. According to the present invention, however, at least one of the auxiliary codes $C_\rho$ and $C_\tau$ is obtained by variable-length coding. This improves a coding compression ratio. The first embodiment not only causes the time lag $\tau$ to be variable-length coded, but also allows adaptive selection between variable-length coding and fixed-length coding on a frame by frame basis.

Figure 4:
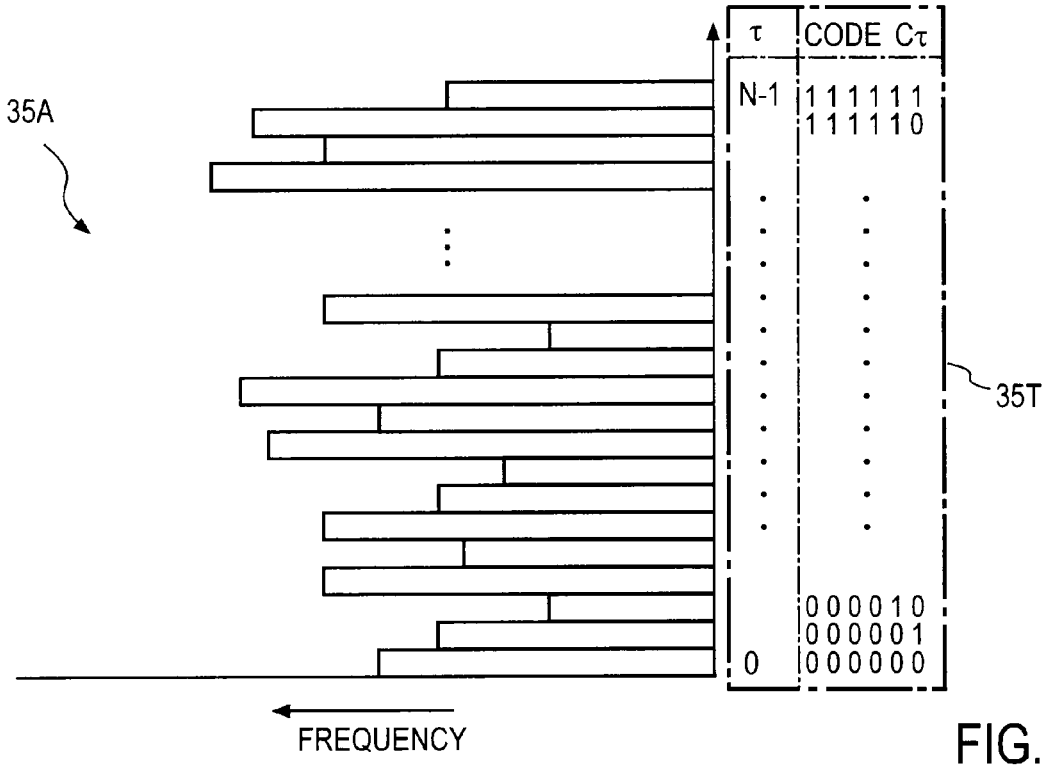
FIG. 4 is a diagram showing an exemplary relationship between occurrence frequencies and codewords of a time lag $\tau$ using a graph and table when a multiplier $\rho'$ is small.

Incidentally, if an input signal is, for example, a background sound (noise) signal which does not contain a pitch component, occurrence frequencies (represented by the abscissa) of various time lags $\tau$ (represented by the ordinate) do not have a regularity or considerable bias as shown in graph 35A on the left of FIG. 4. However, if the input signal contains a pitch component, the time lag $\tau$ has high occurrence frequencies when it is the same as the previous frame's time lag $\tau_0$, twice the $\tau_0$, ½ the $\tau_0$, or equal to $\tau_0-1$ as shown in graph 34A on the left of FIG. 5. This tendency is strong when there is a high correlation among frames of the input signal and the multiplier $\rho$ is large. On the other hand, the tendency shown in graph 35A of FIG. 4 is often conspicuous when there is a low correlation among frames of the input signal and the multiplier $\rho$ is small. Thus, in the first embodiment, the method for coding the time lag $\tau$ is selected based on whether or not the multiplier $\rho$ is large.

As shown in FIG. 1, the multiplier $\rho$ calculated by the multiplier calculating part 18 is coded into a multiplier code $C_\rho$ by the multiplier coder 22 (Step S5). The quantized multiplier $\rho'$ obtained by the multiplier coder 22 during the coding of the multiplier $\rho$ is inputted to a determination part 31*a* of a coding selector 31. The determination part 31*a* determines whether or not $\rho'$ is larger than a predetermined reference value, for example, 0.2 (Step S6). If $\rho'$ is larger than 0.2, the time lag $\tau$ is variable-length coded. In the variable-length coding, a code of a short code length is assigned to a time lag $\tau$ which has particular relationships such as described above with the previous frame's time lag $\tau_0$ and a code of a longer code length which decreases with decreasing differences from $\tau_0$ is assigned to the other time lags. Alternatively, different codes of a fixed code length may be assigned.

According to this embodiment, if $\rho'$ is larger than 0.2, a switch 31*b* is set to the side of a variable-length coder 34 by the determination part 31*a* to give the time lag $\tau$ to the variable-length coder 34. The variable-length coder 34 receives $\tau$ from the switch 31*b* and $\tau_0$ from the frame lag storage 33 and outputs a variable-length lag code $C_\tau$ which corresponds to the received $\tau$ value, for example, with reference to a variable-length code table 34T on the right of FIG. 5 (Step S8).

Figure 5:
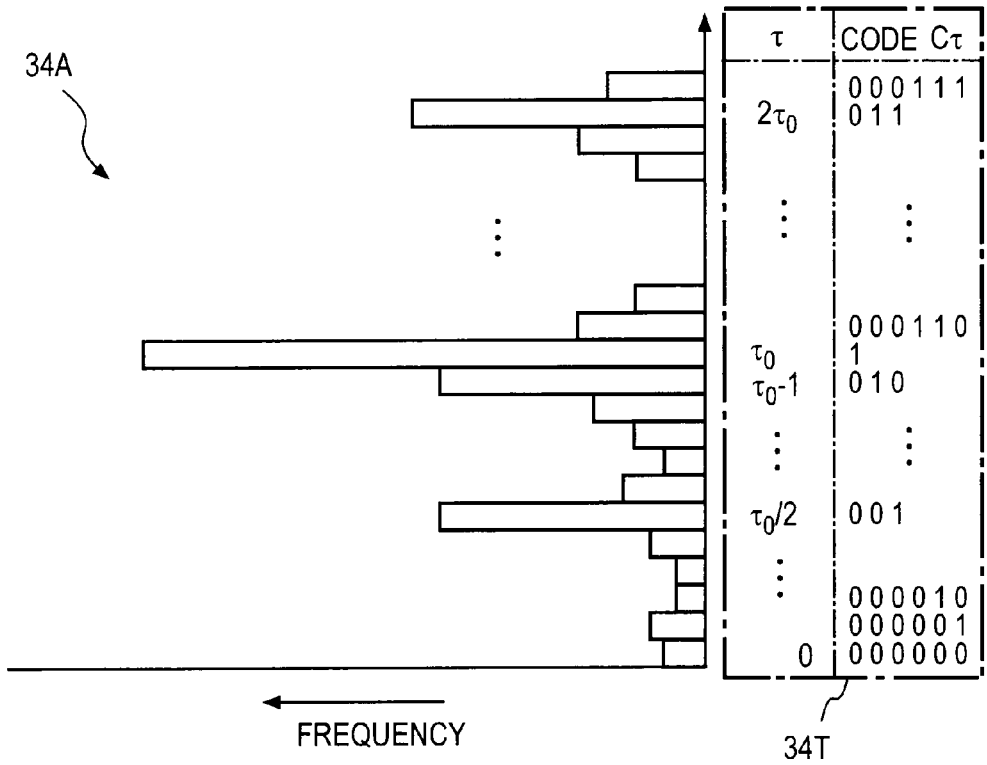
FIG. 5 is a diagram showing an exemplary relationship between occurrence frequencies and codewords of the time lag $\tau$ using a graph and table when the multiplier $\rho'$ is large.

Assignments of a variable-length code to $\tau$ based on the variable-length code table 34T shown in FIG. 5 will be described. Graph 34A in FIG. 5 shows occurrence frequencies of values available for the current frame's time lag $\tau$ when the previous frame's time lag is $\tau_0$, where the available values are determined based on learning. As shown in this example, the frequency at which the time lag $\tau$ is equal to the previous frame's time lag $\tau_0$ is exceedingly high. The frequency at which time lag $\tau$ is equal to $2\tau_0$, $\frac{1}{2}\tau_0$, or $\tau_0-1$ is in between the frequency of $\tau_0$ and the frequencies of time lags other than $2\tau_0$, $\tau_0$, $\frac{1}{2}\tau_0$ and $\tau_0-1$. Thus, in the code assignments shown in the variable-length code table 34T of FIG. 5, since it is most likely that $\tau$ has the same value as $\tau_0$, a code "1" of 1-bit length, which is the shortest, is assigned as a codeword (lag code) $C_\tau$ for $\tau_0=\tau$. Then, different codes "001", "010", and "011" of 3-bit length are assigned as codes $C_\tau$ to the cases which are equally likely to occur, i.e., cases in which $\tau$ is equal to $\frac{1}{2}\tau_0$, $\tau_0-1$ or $2\tau_0$. The remaining values of $\tau$ are each assigned a 6-bit long code whose high-order three digits are "000" and low-order three digits increases with decreasing occurrence frequency. That is, the variable-length code table 34T in FIG. 5 is prepared in advance so that when the input signal contains a pitch component as in the case of a speech signal, a code $C_\tau$ of a short code length will be assigned because the value of time lag $\tau$ is highly likely to have a particular relationship such as described above with the value of the previous frame's time lag $\tau_0$ and that in other cases, codes such as described above will be assigned based on the occurrence frequency of $\tau$ determined experimentally (by learning) in advance. Actually, however, since the occurrence frequency of the time lag $\tau$ varies with the value of the previous frame's time lag $\tau_0$, multiple tables 34T need to be prepared according to the values of $\tau_0$, but there is no need to prepare tables for all possible values of $\tau_0$ (e.g., all the values of 256 to 511 if the search range of $\tau$ is 256 to 511). For example, all the possible values of $\tau_0$ may be divided into multiple regions and a table may be prepared for each of the regions. In that case, an appropriate table is selected based on which region the previous frame's time lag $\tau_0$ belongs to.

Alternatively, variable-length code tables 34T such as shown in FIG. 5 may be stored in the variable-length coder 34 by classifying them into a case in which $\tau$ and $\tau_0$ have a particular relationship and other cases. Then, the time lags $\tau$ and $\tau_0$ are given to a comparator 32 as indicated by dotted lines in FIG. 1. A computing part 32*a* of the comparator 32 computes $2\tau_0$, $\frac{1}{2}\tau_0$, and $\tau_0-1$, compares the time lag $\tau$ with $\tau_0$, $2\tau_0$, $\frac{1}{2}\tau_0$, and $\tau_0-1$ to determine whether it is equal to any of them, and outputs a result of the comparison to the variable-length coder 34. That is, it is determined whether the time lags $\tau$ and $\tau_0$ have a particular relationship with each other (Step S7'). The comparison result from the comparator 32 is inputted to the variable-length coder 34 in addition to $\tau$ from the switch 31*b* and $\tau_0$ from the frame lag storage 33. If the comparison result shows that $\tau$ is equal to any of $\tau_0$, $\frac{1}{2}\tau_0$, $\tau_0-1$, and $2\tau_0$, a coding part 34*a* outputs appropriate one of "1", "001", "010", and "011" as $C_\tau$. In the other cases, the 6-bit code $C_\tau$ corresponding to the time lag $\tau$ is found from the table in the variable-length coder 34 and outputted by a coding part 34*b* (Step S8'). That is, Steps S7' and S8' are carried out instead of Step S8 in FIG. 2. Also, the variable-length coder 34 includes the coding part 34*a* which determines a code for $\tau$ by comparison with $\tau_0$ and the coding part 34*b* which determines a code for $\tau$ based on the occurrence frequency of $\tau$.

If it is found in Step S6 that $\rho'$ is not larger than 0.2, the determination part 31*a* sets the switch 31*b* to the side of a fixed-length coder 35, which then encodes the time lag $\tau$ into a fixed-length lag code $C_\tau$ (Step S9). Since the occurrence frequency of the time lag $\tau$ does not have a regularity or considerable bias as described above, a fixed-length code table 35T, such as shown in FIG. 4, which encodes available values for $\tau$ into fixed-length codes is used as a time lag $\tau$ vs. codeword table. The fixed-length code table 35T is stored in the fixed-length coder 35, which outputs a fixed-length lag code $C_\tau$ corresponding to inputted $\tau$ with reference to the fixed-length code table 35T of this time lag $\tau$.

Incidentally, as a condition for determining whether to encode the time lag $\tau$ into a variable-length code or fixed-length code, the determination part 31*a* uses information as to whether the quantized multiplier $\rho'$ is larger than a predetermined reference value 0.2, but the reference value may be somewhere around 0.3. Also, when the previous frame's quantized multiplier $\rho'_0$ is large, the lag search part 17 may limit the $\tau$'s search range itself to and around $\tau_0$: for example, to $-3 \leqq \tau_0 \leqq 3$, around $2\tau_0$, or around $\frac{1}{2}\tau_0$. This will reduce amounts of computation. However, no previous frame exists at the beginning of information coding. Also, a frame which is to serve as a random access point (access start position) which allows decoding to be started in the middle of information (e.g., a musical piece) encoded into a series of codes must be encoded without using information about the previous frame.

Random access is a function which allows a signal to be reconstructed from the frame at a specified location (access point) in a series of codes without the effects of past frames. It makes it possible to set an access point for each group of frames and reconstruct or packetize the signal on a frame group basis.

Coding techniques which allow access, for example, to coded audio and/or video information broadcast via a network to be started at a random time point include one which establishes a frame subjected to intra-frame coding independently of frames before and after it as an access point in a start frame of information and every certain number of succeeding frames and encodes information for each frame located between adjacent access points using inter-frame prediction coding with high coding efficiency. The use of such coded information makes it possible to start decoding from any access point immediately. According to the present invention, for example, when the waveform coder 21 encodes an error signal from the subtractor 15 using inter-frame prediction coding, it performs intra-frame prediction coding without using information about the previous frame for the start frame of information and access point frames inserted in every certain number of succeeding frames. Regarding a signal used to specify the access point frames, a signal $F_S$ which specifies the access points may be generated in a video information coding apparatus (not shown) used together with the coding apparatus according to the present invention used, for example, as a speech coding apparatus and the access point signal $F_S$ may be given to the coding apparatus according to the present invention. Alternatively, referring to FIG. 1, in relation to a series of frames generated by the signal dividing part 12, an access point setting part 25 indicated by broken lines may generate an access point signal $F_S$ which specifies a start frame and every certain number of succeeding frames as access points and then the waveform coder 21 may perform either intra-frame prediction coding or inter-frame prediction coding of the error signal depending on whether the access point signal $F_S$ is given.

Thus, after Step S2, the determination part 31*a* determines, as indicated by broken lines in FIG. 2, whether the previous frame's time lag $\tau_0$ is available, based on whether or not the access point signal $F_S$ is given (Step S14). If it is available, the determination part 31*a* reads the quantized multiplier $\rho'$ of the previous frame (hereinafter referred to as the previous frame's quantized multiplier $\rho'_0$) out of a storage (not shown) (Step S15). Then, it determines whether the previous frame's quantized multiplier $\rho'_0$ is larger than a predetermined reference value, for example, 0.2 (Step S16). If $\rho'_0$ is larger than the predetermined value, the determination part 31*a* searches only a small area around the previous frame's time lag $\tau_0$ for a time lag and then the determination part 31*a* goes to Step S7 (Step S17). If it is found in Step S16 that $\rho'_0$ is not larger than the reference value, the determination part 31*a* searches a large area for a time lag as is conventionally the case and then goes to Step S9 (Step S18). If it is found in Step S14 that the previous frame's time lag $\tau_0$ is not available, the determination part 31*a* goes to Step S3. Also, in Step S5' surrounded by broken lines, the multiplier $\rho$ is calculated and encoded, and also the quantized multiplier $\rho'_0$ resulted from encoding is stored. Incidentally, in the case of an access point frame, it is necessary to determine $\rho$ by searching for $\tau$ based solely on intra-frame information. Consequently, the coding apparatus also inputs the access point signal $F_S$ in the delay part 13. When the access point signal $F_S$ is inputted, the delay part 13 generates a vector $X_\tau$ of the time delayed signal with x(i) of the previous frame set to 0 (i.e., with x(i)(i<0) replaced by 0) and inputs the vector $X_\tau$ in the lag search part 17, multiplier calculating part 18, and multiplying part 14. Regarding the access point signal $F_S$, it may be sent out to the decoding side together with a coded video signal by the video information coding apparatus (not shown) or an access point signal $F_S$ generated by the access point setting part 25 may be sent to the decoding side. Alternatively, a means of generating access point information may be provided on the coding side as a system and transmitted to the decoding side in a layer different from the speech signal and video signal.

An input sample time-series signal is delayed $\tau$ by the delay part 13 and the delayed signal is multiplied by the quantized multiplier $\rho'$ (Step S10) to generate a long-term prediction signal. The long-term prediction signal is subtracted from the input sample time-series signal x(i) by the subtractor 15 (Step S11) and a resulting residual waveform signal (error signal) y(i) is encoded into a waveform code $C_W$ by the waveform coder 21 (Step S12). The combiner 24 combines $C_W$, $C_\rho$, and $C_\tau$ and outputs the resulting code (Step S13).

According to the first embodiment, either fixed-length coding or variable-length coding is selected for the time lag $\tau$ according to the quantized multiplier $\rho'$. Moreover, if variable-length coding is selected, an appropriate $\tau$ vs. codeword table assigns a code of a short code length to $\tau$ which is equal to the previous frame's time lag $\tau_0$, an integral multiple of $\tau_0$, an integral submultiple of $\tau_0$, or a value around $\tau_0$. This improves a coding compression ratio. The variable-length coder 34 differs from typical variable-length code tables in that it has the coding part 34*a* which receives $\tau_o$, $2\tau_0$, $\frac{1}{2}\tau_0$, and $\tau_0-1$ and outputs a code $C_\rho$ and the coding part 34*b* which receives $\tau$ and outputs a code $C_\rho$.

Decoding Side

Figure 6:
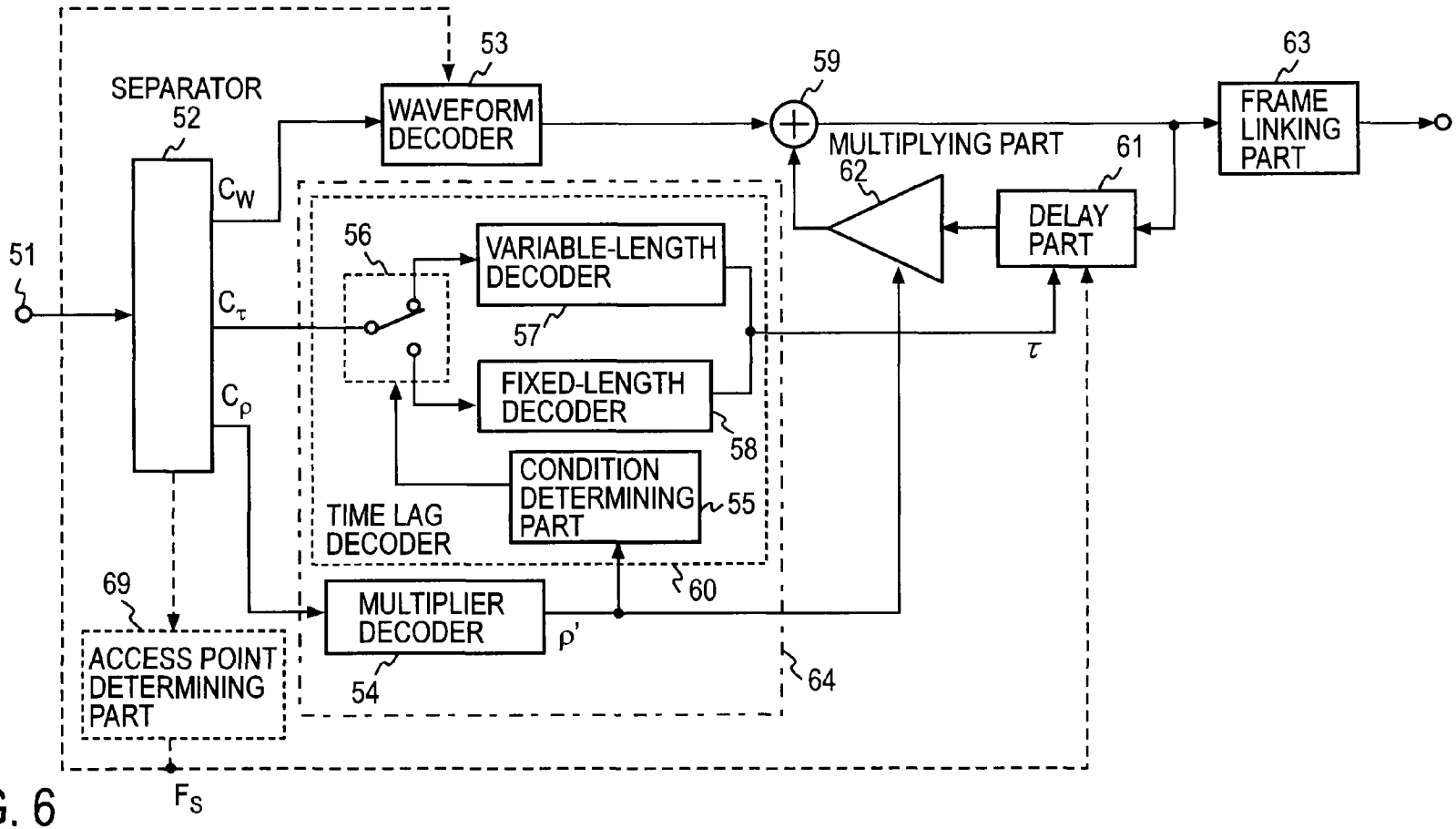
FIG. 6 is a block diagram showing a functional configuration example of a decoding apparatus according to a first embodiment.
Figure 7:
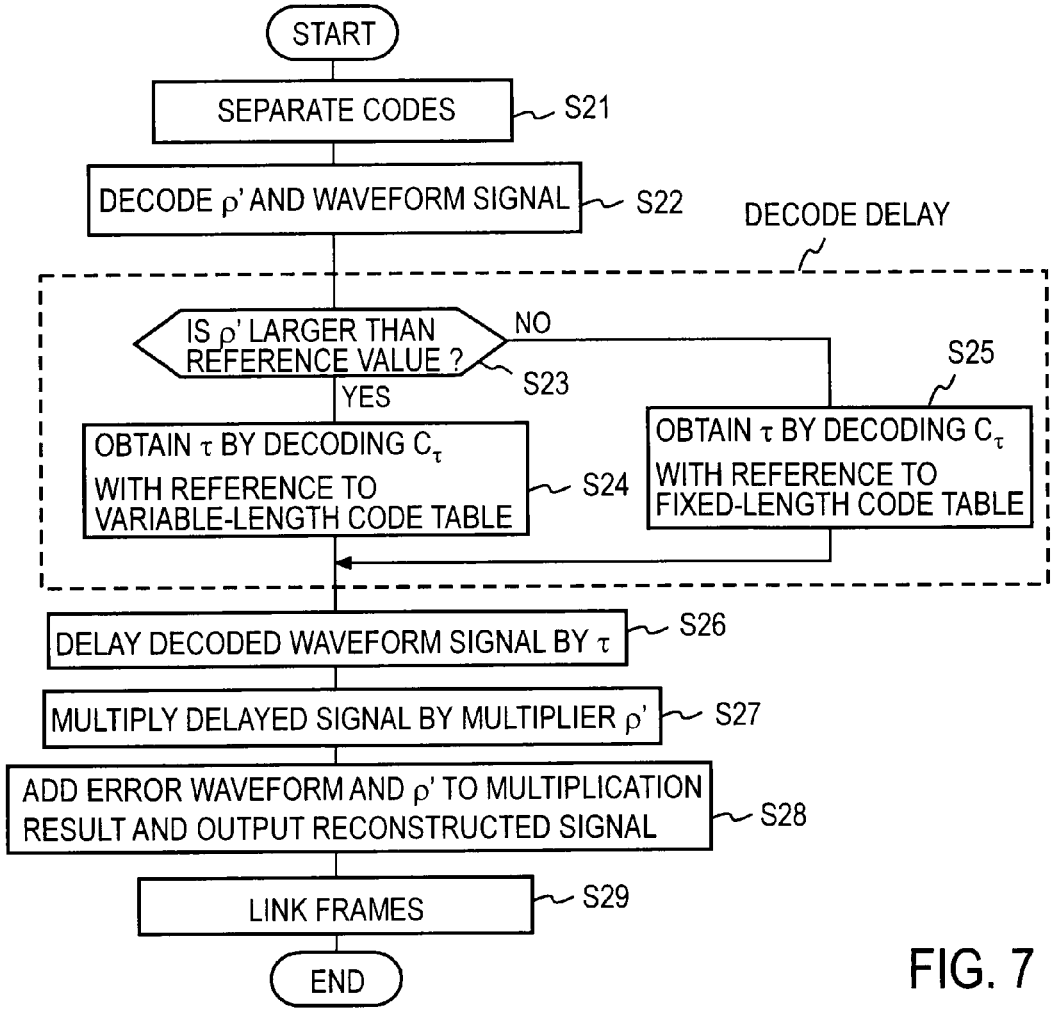
FIG. 7 is a flowchart showing an exemplary processing procedure of the apparatus shown in FIG. 6.

FIGS. 6 and 7 show a functional configuration example and processing procedure of a decoding apparatus, respectively, corresponding to the coding apparatus and its processing procedure shown in FIGS. 1 and 2. An input code from an input terminal 51 is separated into the waveform code $C_W$, lag code $C_\tau$, and multiplier code $C_\rho$ on a frame by frame basis by a separator 52 (Step S21). The access point signal $F_S$ may be given, for example, by a video information decoding apparatus (not shown). Alternatively, access point information received by the system in a different layer may be used. According to this embodiment of the decoding apparatus, if an access point determining part 69 detects that the access point signal $F_S$ exists in the codes separated by the separator 52, decoding is started from the given frame. The waveform code $C_W$ is decoded into the error signal by a waveform decoder 53 (Step S22). Also, the multiplier code $C_\rho$ is decoded into the quantized multiplier $\rho'$ by a multiplier decoder 54 (Step S22).

A condition determining part 55 determines whether the quantized multiplier $\rho'$ is larger than a predetermined value, the same value as the reference value used as a determination condition by the determination part 31*a* in FIG. 1, where the reference value in the above example is 0.2 (Step S23). If $\rho'$ is larger than 0.2, a switch 56 is set to the side of a variable-length decoder 57, and the lag code $C_\tau$ is decoded by the variable-length decoder 57 to obtain the time lag $\tau$ (Step S24). The variable-length decoder 57 stores a variable-length code table 34T of the time lag $\tau$ identical to the one stored in the variable-length coder 34 in FIG. 1. If it is determined in Step S23 that $\rho'$ is equal to or smaller than 0.2, the switch 56 is set to the side of a fixed-length decoder 58, and the lag code $C_\tau$ is decoded by the fixed-length decoder 58 to obtain the time lag $\tau$ (Step S25). The fixed-length decoder 58 stores a fixed-length code table 35T of the time lag $\tau$ identical to the one stored in the fixed-length coder 35 in FIG. 1.

A decoded waveform signal outputted from an adder 59 is delayed the decoded time lag $\tau$ by a delay part 61 (Step S26), the decoded signal delayed $\tau$ samples is multiplied by the decoded quantized multiplier $\rho'$ by a multiplying part 62 (Step S27), and the result of multiplication is added to the decoded error signal by the adder 59 to obtain a decoded waveform sample time-series signal (Step S28). Incidentally, in the case of an access point frame, the delay part 61 generates a time delayed signal with x(i) of the previous frame set to 0 and inputs the time delayed signal in the multiplying part 62, as in the case of the coding apparatus. Such a sample time-series signal is obtained for each frame and the sample time-series signals of samples are linked and outputted by a frame linking part 63 (Step S29). The variable-length decoder 57, fixed-length decoder 58, condition determining part 55, and switch 56 compose a lag decoder 60. Also, the lag decoder 60 and multiplier decoder 54 compose an auxiliary information coder 64.

Second Embodiment

According to the first embodiment, the time lag $\tau$ is variable-length coded depending on a condition. According to the second embodiment, the multiplier $\rho$ is variable-length coded depending on a condition. The coder 23 may variable-length encode the time lag $\tau$ depending on a condition as in the case of the first embodiment or may only fixed-length encode as is conventionally the case. Depending on the method of coding, the lag decoder 60 of the decoding apparatus is designed for either variable-length decoding, or fixed-length decoding as is conventionally the case.

Thus, only such coding of the multiplier $\rho$ that is different from the first embodiment and conventional techniques will be described below. Auxiliary information which clearly indicates adaptive selection of a code table of the multiplier $\rho$ may be used as is the case with the selection of a code table of time lag $\tau$, but a case in which selection is not indicated clearly will be described below.

Figure 8:
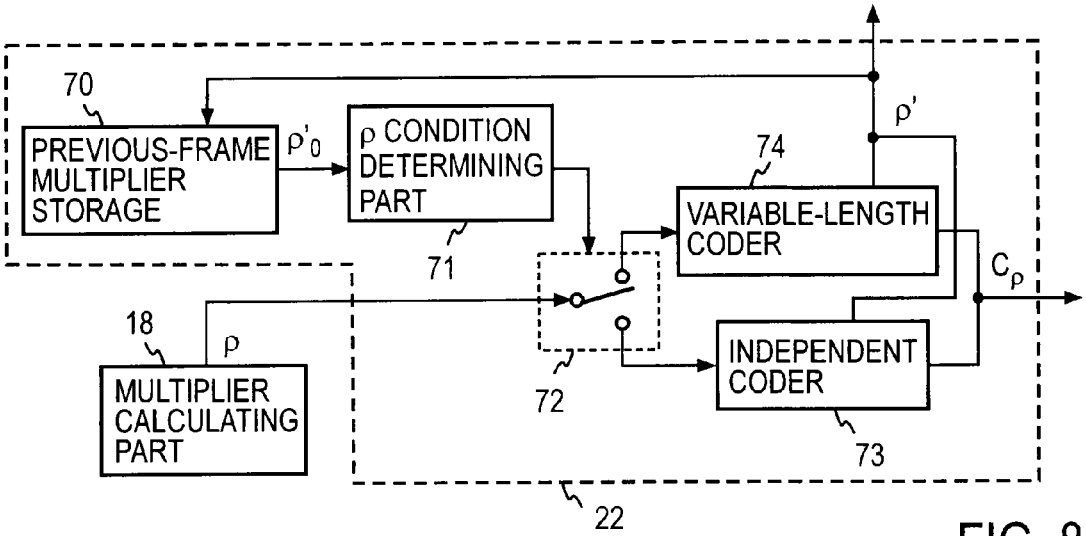
FIG. 8 is a block diagram showing a functional configuration example of the essence of a coding apparatus according to a second embodiment.
Figure 9:
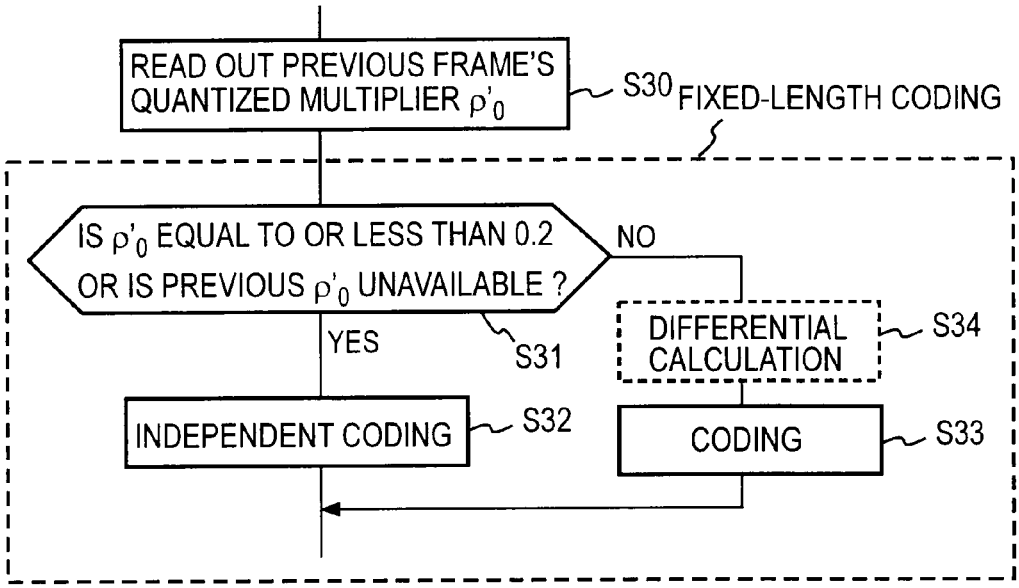
FIG. 9 is a flowchart showing an exemplary processing procedure of the apparatus shown in FIG. 8.

FIG. 8 shows a functional configuration example of the multiplier coder 22 according to the second embodiment applied to the multiplier coder 22 of the coding apparatus shown in FIG. 1 while FIG. 9 shows its processing procedure. A previous-frame multiplier storage 70 stores a quantized multiplier $\rho'$ which has been quantized in the previous frame by the multiplier coder 22. The quantized multiplier $\rho'$ is taken as the previous frame's quantized multiplier $\rho'_0$ out of the previous-frame multiplier storage 70 (Step S30), a $\rho$ condition determining part 71 determines whether the previous frame's quantized multiplier $\rho'_0$ is equal to or smaller than a predetermined reference value, for example, 0.2, or whether $\rho'_0$ is unavailable (Step S31). If $\rho'_0$ is equal to or smaller than the reference value or if $\rho'_0$ is unavailable, a switch 72 is set to an independent coder 73 and the multiplier $\rho$ is encoded into a code $C_\rho$ of a fixed-length codeword or variable-length codeword (Step S32). If it is determined in Step S31 that $\rho'_0$ is larger than the reference value, the switch 72 is set to a variable-length coder 74 and the multiplier $\rho$ is variable-length coded into a variable-length codeword $C_\rho$ (Step S33).

Figure 10:
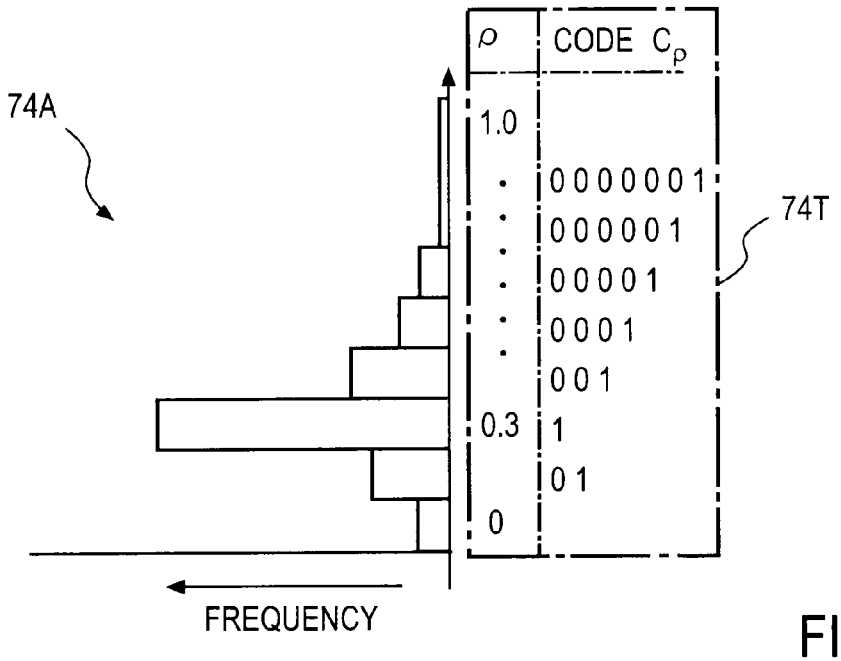
FIG. 10 is a diagram showing an exemplary relationship between occurrence frequencies and codewords of a multiplier $\rho$ using a graph and a table when a multiplier $\rho'$ is larger than a reference value.

When the previous frame's quantized multiplier $\rho'_0$ is larger than the reference value, in an occurrence frequency distribution of the multiplier $\rho$ of the current frame, the frequency is the highest when $\rho$=0.2 to 0.3, for example, as shown in graph 74A in FIG. 10. Thus, as can be seen from the multiplier's variable-length code table 74T shown in FIG. 10, for example, the shortest code "1" is assigned to the value of 0.3 and a longer code is assigned with increasing or decreasing values.

The multiplier code $C_\rho$ encoded by the coder 73 or 74 and the quantized multiplier $\rho'$ quantized through coding are outputted from the multiplier coder 22 and the quantized multiplier $\rho'$ is stored in the previous-frame multiplier storage 70 for use as the previous frame's quantized multiplier $\rho'_0$ in the next frame.

Coding performed when the multiplier $\rho'_0$ is small will be described further. When the previous frame's quantized multiplier $\rho'_0$ is small or when information about the previous frame is unavailable, the frame is coded independently by the independent coder 73. Examples in which information about the previous frame is unavailable include the first frame and an access point (access start) frame for random access.

Figure 11:
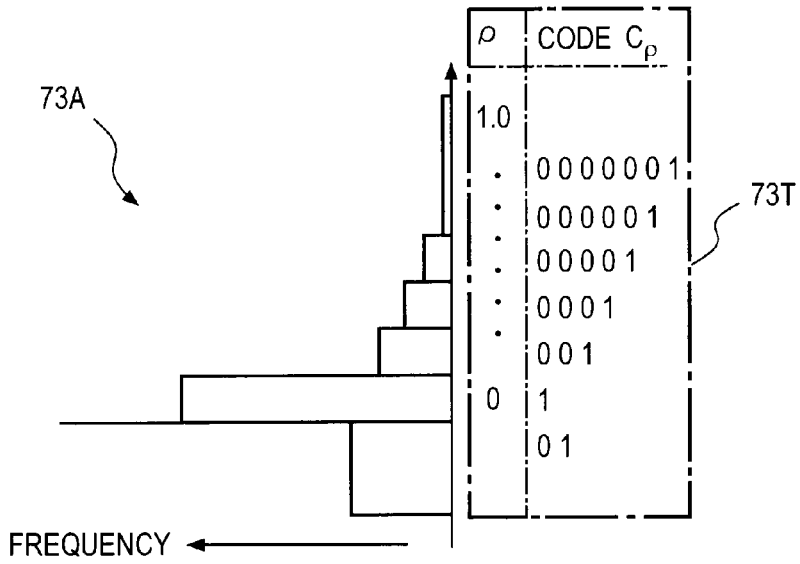
FIG. 11 is a diagram showing an exemplary relationship between occurrence frequencies and codewords of the multiplier $\rho$ using a graph and table when the multiplier $\rho'$ is not larger than the reference value.

The independent coder 73 may encode the multiplier $\rho$ into a code $C_\rho$ of a fixed-length codeword or, as described below, into a code $C_\rho$ of a variable-length codeword. An example of a variable-length code table of the multiplier $\rho$ used when the independent coder 73 performs variable-length coding is shown as table 73T in FIG. 11. Graph 73A in FIG. 11 shows the occurrence frequencies of various values of the current frame's multiplier $\rho$ when the previous frame's quantized multiplier $\rho'_0$ is smaller than the reference value. As shown in the graph, "1" is assigned to small multiplier $\rho$ values, which have extremely high occurrence frequencies in the case of, for example, an access point frame. The occurrence frequency decreases with increases in the value of the multiplier ρ, and thus a longer code is assigned. In this example, the binary value of every codeword is 1, but with decreases in the occurrence frequency, more 0s are added as high-order digits, increasing the number of digits of the codeword.

When applying the embodiment of the multiplier coder 22 shown in FIG. 8 to the coding apparatus in FIG. 1, the lag coder 23 may be configured to selectively perform variable-length coding and fixed-length coding as shown in FIG. 1. Alternatively, it may be configured to always perform either fixed-length coding or variable-length coding of the time lag τ without selecting a coding method based on the quantized multiplier ρ'.

Figure 12:
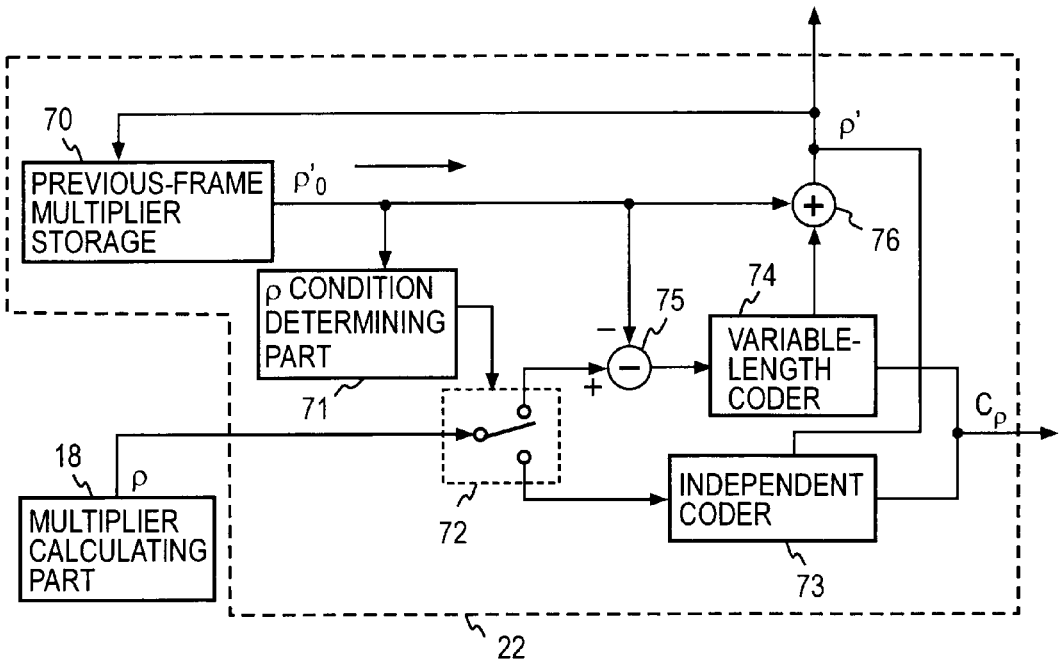
FIG. 12 is a block diagram showing another embodiment of a multiplier coder 22.

As another embodiment of the multiplier coder 22, a configuration in which difference between the current frame's multiplier ρ and previous frame's quantized multiplier $\rho'_0$ is coded instead of the coding of ρ in FIG. 8 is shown in FIG. 12. Processing procedure of the multiplier coder 22 is shown by adding Step S34 surrounded by broken lines to FIG. 9. A difference calculating part 75 is installed between the switch 72 and variable-length coder 74 to calculate difference $\Delta\rho=\rho-\rho'_0$ between the previous frame's quantized multiplier $\rho'_0$ from the previous-frame multiplier storage 70 and current frame's multiplier ρ. If it is determined in Step S31 that the previous frame's quantized multiplier $\rho'_0$ is not larger than the predetermined value, the switch 72 is set to the difference calculating part 75, which then calculates the difference $\Delta\rho=\rho-\rho'_0$ between the previous frame's quantized multiplier $\rho'_0$ and current frame's multiplier ρ (Step S34). The variable-length coder 74 encodes the calculation result Δρ into a code $C_\rho$ and gives a quantized difference Δρ' obtained in the coding to an adder 76 (Step S33). Also, the adder 76 generates a current frame's quantized multiplier ρ' by adding the quantized difference Δρ' and the previous frame's quantized multiplier $\rho'_0$, and stores it in the previous-frame multiplier storage 70 for use as the previous frame's quantized multiplier $\tau'_0$ for the next frame. The rest of the configuration and operation is the same as in FIG. 8.

Figure 13:
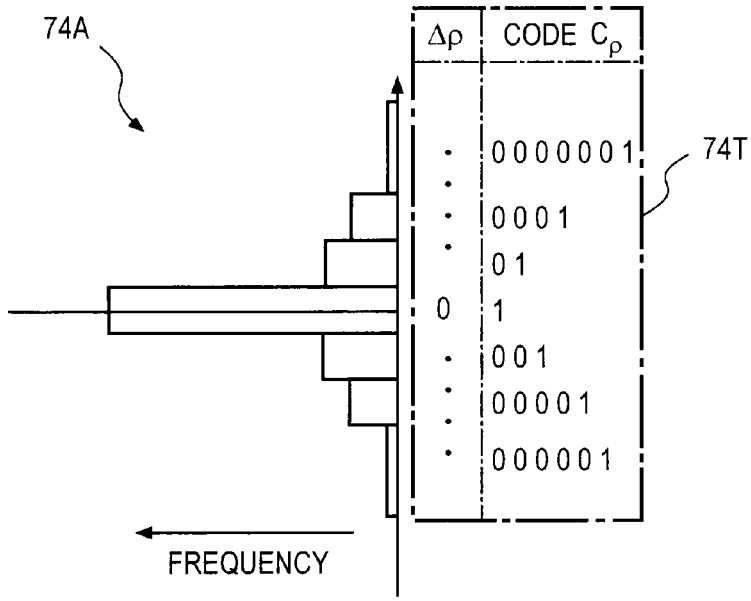
FIG. 13 is a diagram showing a relationship between occurrence frequencies and codewords of a difference multiplier $\Delta\rho$ using a graph and a table.

When the previous frame's quantized multiplier $\rho'_0$ is large, it is highly likely that the current frame's multiplier ρ is large as well. Therefore, the occurrence frequency decreases with increasing distance between the current frame's multiplier ρ and the previous frame's quantized multiplier $\rho'_0$, i.e., with increases in the absolute value of the difference Δρ. Thus, as shown in the variable-length code table 74T in FIG. 13, a longer codeword is assigned to the $C_\rho$ with decreases in the occurrence frequency of the difference value between ρ and $\rho'_0$ as in the case of FIG. 10. The example in FIG. 13 shows how high-order zeros are added one by one to the codeword with increases in the difference Δρ.

In coding of the multiplier ρ or difference Δρ, generally their values are not integers. Thus, for example, a range of variation of ρ is divided into small ranges and a code of a smaller code length is assigned to a resulting small range to which smaller values of ρ belong. Also, a central value (generally an integer) is determined for each small range obtained by the division. The codeword of the small range to which inputted ρ belongs is outputted as the code $C_\rho$ and the central value of the small range is outputted as the decoded quantized multiplier ρ'. This quantized multiplier ρ' is inputted, for example, in the multiplying part 14 and determination part 31*a* in FIG. 1.

Figure 14:
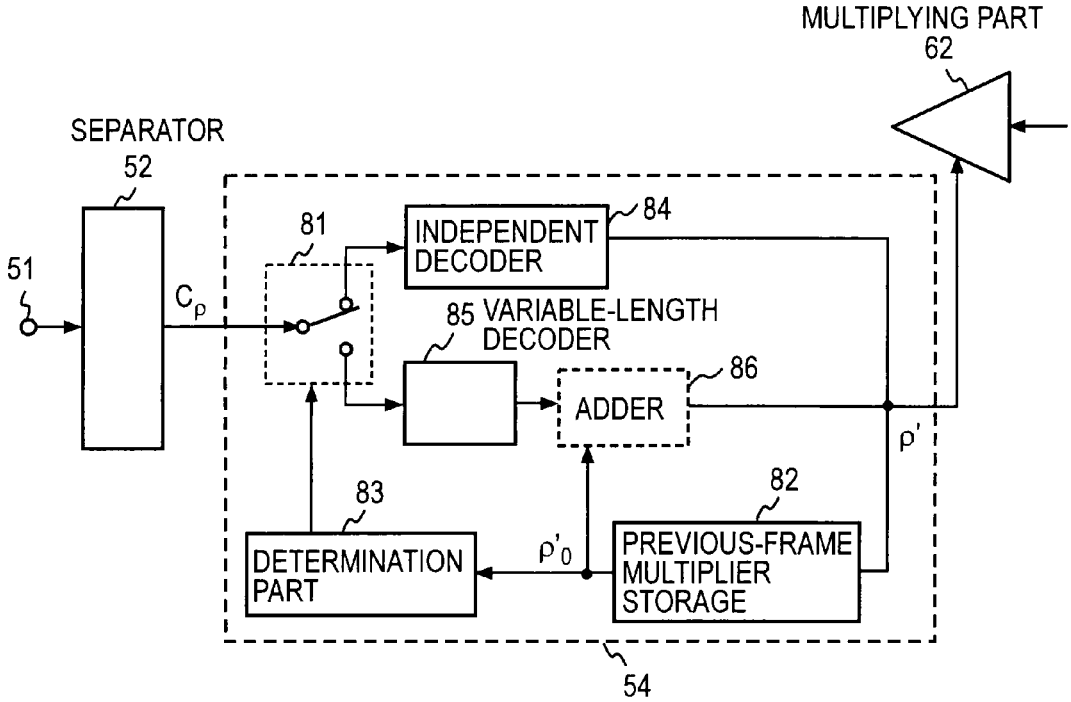
FIG. 14 is a block diagram showing a functional configuration example of a multiplier decoder 54 on the decoding side according to the second embodiment.
Figure 15:
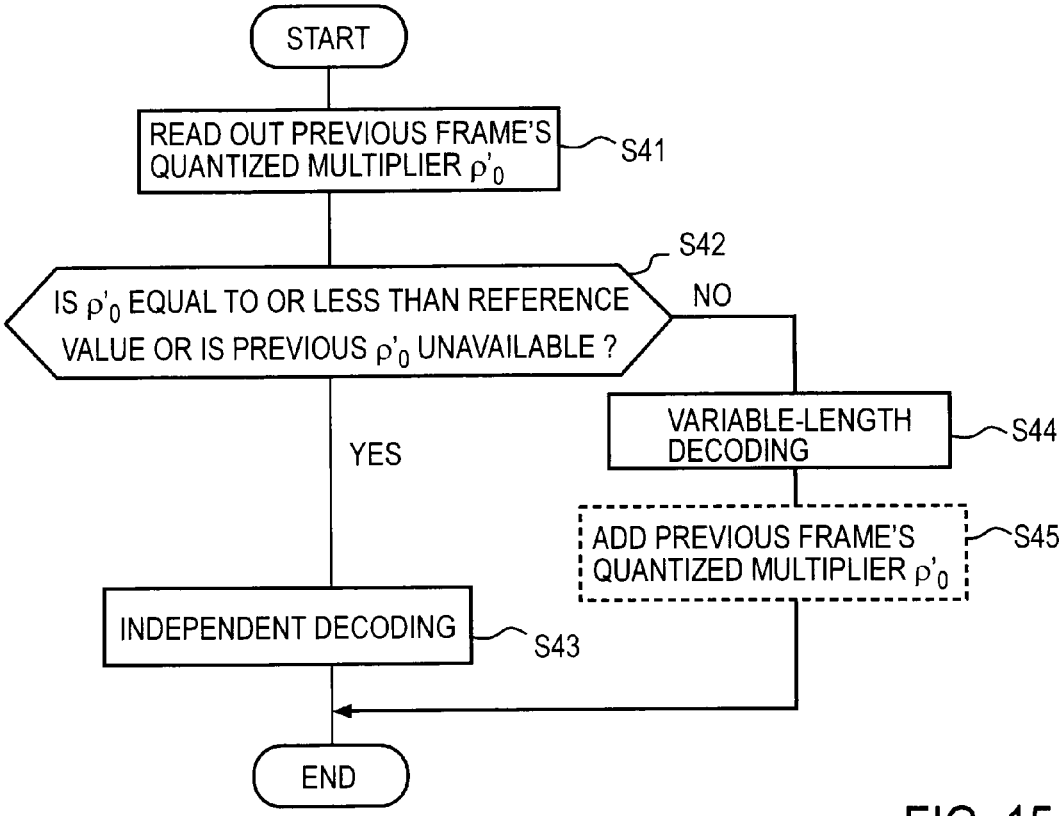
FIG. 15 is a flowchart showing an exemplary processing procedure of the apparatus shown in FIG. 14.

FIG. 14 shows a functional configuration example of the multiplier decoder 54 on the decoding side and FIG. 15 shows an exemplary processing procedure of the apparatus shown in FIG. 14, where the multiplier decoder 54 corresponds to the multiplier coder 22 shown in FIG. 8 and described above.

The multiplier code $C_\rho$ from the separator 52 is inputted to a switch 81. On the other hand, the previous frame's quantized multiplier $\rho'_0$ is taken out of a previous-frame multiplier storage 82 (Step S41). A determination part 83 determines whether the previous frame's quantized multiplier $\rho'_0$ is equal to or smaller than a predetermined reference value or whether $\rho'_0$ is unavailable (Step S42). The reference value is the same value as the reference value used for the determination in Step S31 on the coding side. If it is determined that the previous frame's quantized multiplier $\rho'_0$ is equal to or smaller than the reference value or unavailable, a switch 81 is set to an independent decoder 84 and the inputted code $C_\rho$ is decoded by the independent decoder 84 (Step S43).

If it is determined in Step S42 that $\rho'_0$ is larger than the reference value, the switch 81 is set to a variable-length decoder 85 and the code $C_\rho$ is decoded by the variable-length decoder 85 (Step S44). The independent decoder 84 and variable-length decoder 85 correspond to the independent coder 73 and variable-length coder 74 on the coding side. In this example, a table identical to the table 74T shown in FIG. 10 is stored in the independent decoder 84.

If the difference Δρ between ρ and $\rho'_0$ has been variable-length coded on the coding side using the multiplier coder 22 shown in FIG. 12, an adder 86 adds the previous frame's quantized multiplier $\rho'_0$ to a difference signal decoded by the variable-length decoder 85 to obtain the quantized multiplier ρ' as indicated by broken lines in FIGS. 14 and 15 (Step S45). In this case, a table identical to the table 74T shown in FIG. 13 is stored in the variable-length decoder 85.

Figure 16:
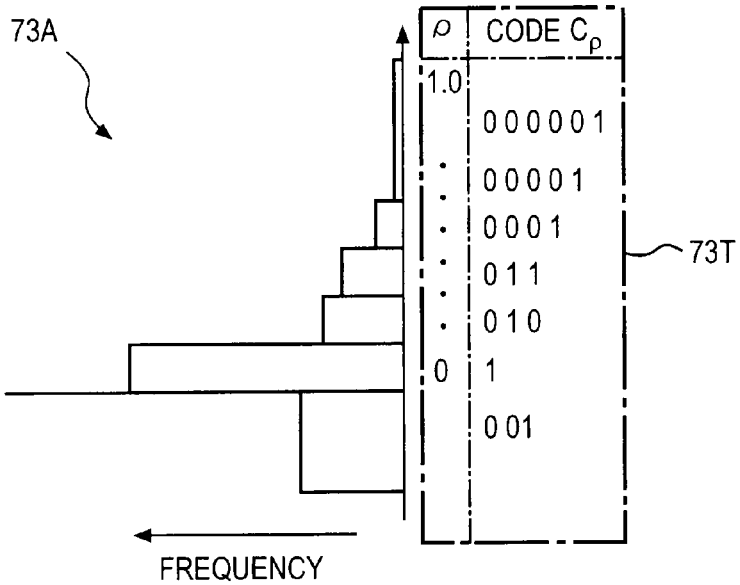
FIG. 16 is a diagram showing another exemplary relationship between occurrence frequencies and codewords of a multiplier using a graph and a table.
Figure 17:
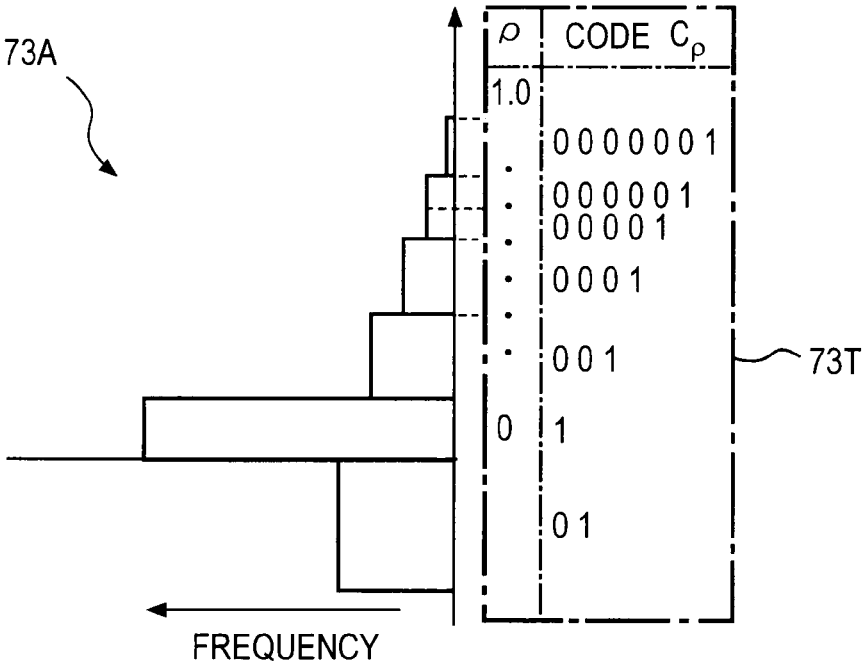
FIG. 17 is a diagram showing another exemplary relationship between occurrence frequencies and codewords of a multiplier.

Another example of code assignments based on independent coding, such as the one shown in FIG. 11, is shown in FIG. 16. As shown in this example, in a range in which there is not much difference in the frequency, the binary value may be increased or decreased one by one with the number of digits kept constant as exemplified by "001", "010", and "011" in the figure instead of increasing the number of digits successively with increases in the frequency. If ρ is large, it affects the waveform signal greatly. Thus, as shown in FIG. 17, where ρ is particularly large, the value of the multiplier ρ may be graduated finely. This increases the numbers of codewords and digits, but since such large ρ occurs very infrequently, it has little effect on the amount of code as a whole. Thus, accuracy of the decoded waveform signal can be increased.

Variations

In the above description, variable-length coding and decoding are performed by maintaining a relationship between a parameter (τ, ρ, or Δρ) and codeword as a code table. However, in the examples shown in FIGS. 5, 11, 13, 16, 17, and the like, the relationship between the magnitude of the parameter and codeword has regularity. For example, if the value of ρ is known, its codeword can be obtained by adding a predetermined number of high-order zeros to 1 according to rules. Conversely, the value of ρ' can be determined from the codeword according to rules. That is, in such cases, there is no need to use a code table of the parameter in the variable-length coder and decoder.

In coding according to the code table in FIG. 5, the comparator 32 determines whether any of $\tau=\tau_0$, $\tau=\tau_0-1$, $\tau=\frac{1}{2}\tau_0$, and $\tau=2\tau_0$ is satisfied. If any of them is satisfied, the variable-length coder 34 outputs a code $C_\rho$ of an appropriate short code length (1 or 3 bits in this example). Alternatively, the comparator 32 may determine whether, for example, any of $\tau=\tau_0+1$, $\tau=\frac{1}{3}\tau_0$, $\tau=\frac{1}{4}\tau_0$, $\tau=3\tau_0$, $\tau=4\tau_0$ in addition to the above relation is satisfied and the variable-length coder 34 may output a predetermined code $C_\rho$ of a short code length if any of the above relations is satisfied.

According to the first embodiment, it is determined whether to use the variable-length code table 34T of the time lag $\tau$ shown in FIG. 5 (variable-length coding) or fixed-length code table 35T of the time lag $\tau$ shown in FIG. 4 (fixed-length coding) based on whether the multiplier $\rho'$ is large or small.

Figure 18:
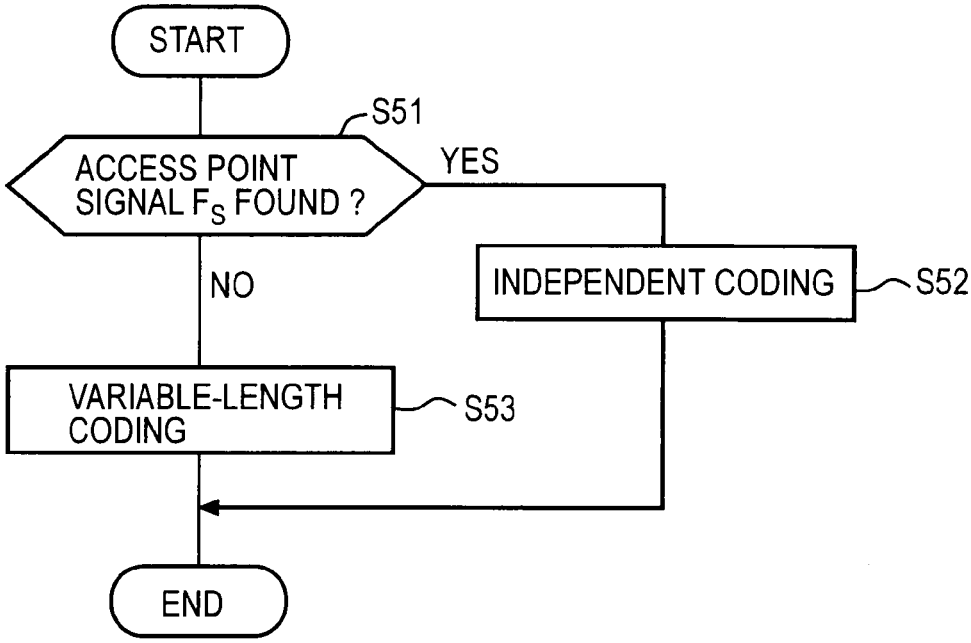
FIG. 18 is a flowchart showing another example of the procedure for encoding a time lag $\tau$.
Figure 19:
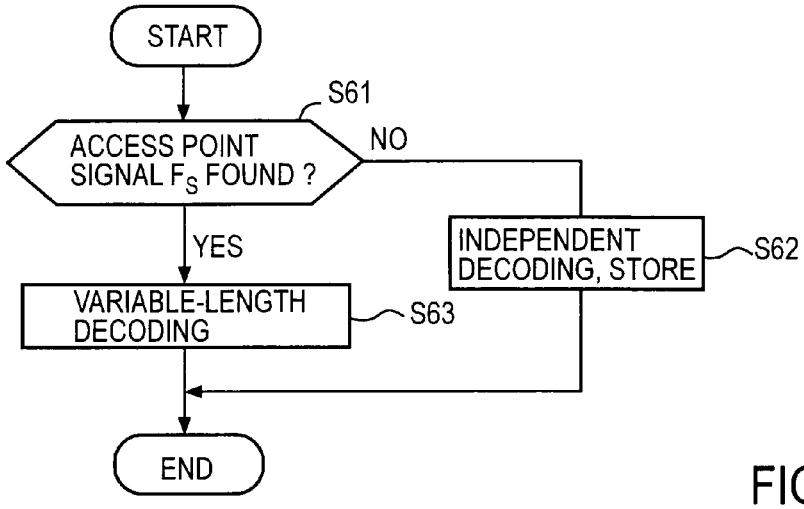
FIG. 19 is a flowchart showing an example of the decoding procedure corresponding to FIG. 18.

Alternatively, a method for coding the time lag $\tau$ may be selected based on whether the current frame should be coded independently, i.e., whether the current frame should be coded as an access point frame. In that case, it is determined whether information about the previous frame is available, for example, as shown in FIG. 18 (Step S51). It is determined here whether or not the current frame should be coded independently based on whether or not access point signal $F_S$ is given to the determination part 31*a* by the access point setting part 25 as indicated by broken lines in FIG. 1. If the access point signal $F_S$ is given to the determination part 31*a*, meaning that the current frame is an access point frame, the time lag $\tau$ is coded independently without using information about the previous frame (Step S52). The coding here uses, for example, the code table 35T shown in FIG. 4. If it is found in Step S51 that no signal $F_S$ is provided, it is determined that coding should be performed using the information about the previous frame and the current frame's time lag $\tau$ is variable length coded (Step S53). In this case, for example, the code table 34T shown in FIG. 5 is used. The decoding in FIG. 6 is performed, for example, as shown in FIG. 19. First, it is determined whether there is previous-frame information which indicates whether or not to use independent decoding (Step S61). If there is no previous-frame information, the time lag code $C_\tau$ is decoded independently (Step S62). If it is determined in Step S61 that there is previous-frame information, the time lag code $C_\tau$ is variable-length decoded (Step S63).

Figure 20:
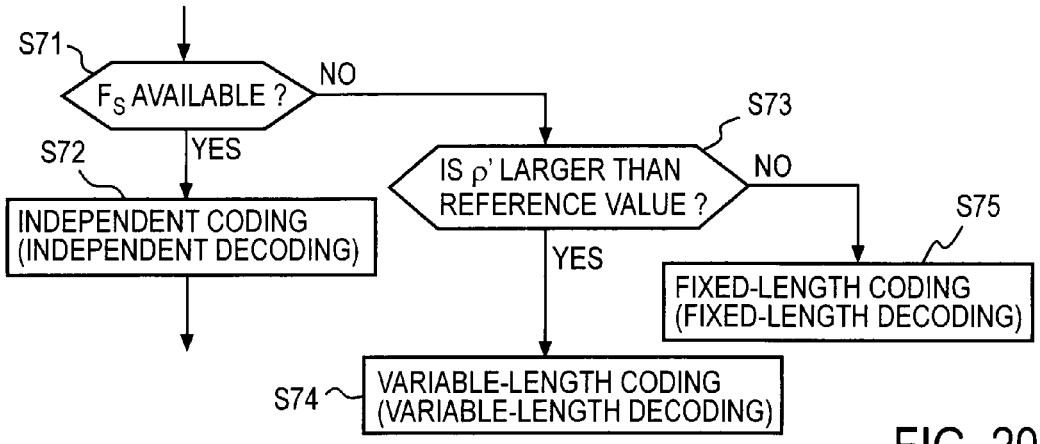
FIG. 20 is a flowchart showing another example of the processing procedure for selecting a coding method of time lags $\tau$.

The method for coding the time lag $\tau$ may be selected based on a combination of conditions, i.e., whether or not the current frame should be coded independently and the magnitude of the quantized multiplier $\rho'$. In that case, the determination part 31*a* in FIG. 1 receives the access point signal $F_S$ which indicates whether or not the current frame should be coded independently as well as the quantized multiplier $\rho'$ from the multiplier coder 22. The determination part 31*a* checks for an access point signal $F_S$ which indicates that the current frame should be coded independently, for example, as shown in FIG. 20 (Step S71). If $F_S$ is present, the time lag $\tau$ is coded independently (Step S72). If no $F_S$ is found in Step S71, i.e., if there is previous-frame information, it is determined whether or not the quantized multiplier $\rho'$ is larger than a reference value (Step S73). If it is larger than the reference value, the time lag $\tau$ is variable-length coded (Step S74), but it is not larger than the reference value, the time lag $\tau$ is fixed-length coded (Step S75).

The processes on the decoding side is the same as on the coding side. That is, as shown in angle brackets in FIG. 20, it is determined whether $F_S$ is present in the received code. If one is present, $C_\tau$ is decoded independently. If no $F_S$ is present, $C_\tau$ is variable-length decoded if the decoded $\rho'$ is larger than a predetermined value, or $C_\tau$ is fixed-length decoded if $\rho'$ is not larger than the predetermined value.

Referring to FIG. 13, it is known, without learning the occurrence frequency of the difference value, that the smaller the absolute value of the differential value between $\rho$ and $\rho'$, the higher its occurrence frequency. Thus, a variable-length code table 74T of the multiplier $\rho$ may be created by assigning codewords whose code length increases with increases in the absolute value of the difference value, for example, as shown in FIG. 13.

Third Embodiment

The multiplier coder 22 in FIG. 8 may be applied to FIG. 1 in such a way as to optimize a combination of coding by the waveform coder 21 and coding by the multiplier coder 22. Such a configuration can be obtained by adding an optimizing part to the configuration in FIG. 1. Its essence is shown in FIG. 21.

Figure 21:
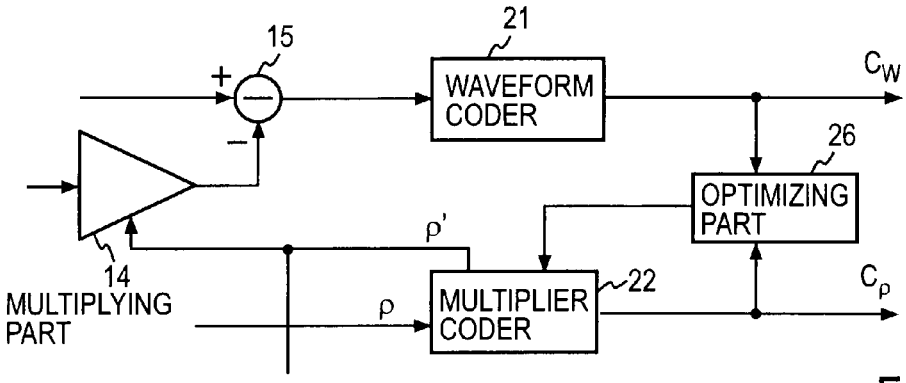
FIG. 21 is a block diagram showing a configuration of essential parts for illustrating the coding which optimizes a combination of multiplier coding and waveform coding.

With the configuration in FIG. 21, an optimizing part 26 receives an output code $C_W$ from the waveform coder 21 and an output code $C_\rho$ from the multiplier coder 22, the sum of the amounts of codes (total bit counts) is calculated, and the quantized multiplier $\rho'$ is varied (i.e., selection of $\rho'$ in the code table is changed) during the selected variable-length coding performed by the multiplier coder 22, in such a way as to decrease the total amount of codes. Furthermore, the multiplying part 14 performs multiplication using the selected $\rho'$, the subtractor 15 performs subtraction using the result of multiplication, and the waveform coder 21 performs coding using the result of subtraction. In this way, the $\rho'$ which minimizes the total code amount of $C_W$ and $C_\rho$ is determined by varying $\rho'$. The $C_W$ and $C_\rho$ which minimize the total amount of codes are given to the combiner 24 as coding results. The rest of the configuration and operation is the same as in FIG. 1. Decoding which corresponds to such optimized coding can be performed by the decoding apparatus in FIG. 6 using the multiplier decoder 54 in FIG. 14.

Similarly, the code $C_\tau$ from the lag coder 23 may be determined in such a way as to minimize the total code amount of the code $C_W$ from the waveform coder 21 in FIG. 1 and the code $C_\tau$ from the lag coder 23. Specifically, the process of the delay part 13 and downstream processes are performed by varying the time lag $\tau$ provided by the lag search part 17 in such a way as to minimize the total code amount of the code $C_W$ and code $C_\tau$, and the code $C_W$ and code $C_\tau$ which minimizes the total amount of codes are given to the combiner 24 as a coding result.

As described above, when the time lag $\tau$ is varied, the multiplier $\rho$ is affected, affecting the code $C_\rho$, and the error signal y(i) is affected, affecting the code $C_W$. Thus, both or each of the quantized multiplier $\rho'$ and time lag $\tau$ may be adjusted in such a way as to minimize the total code amount of the three codes $C_W$, $C_\rho$, and $C_\tau$ combined.

Fourth Embodiment

Figure 22:
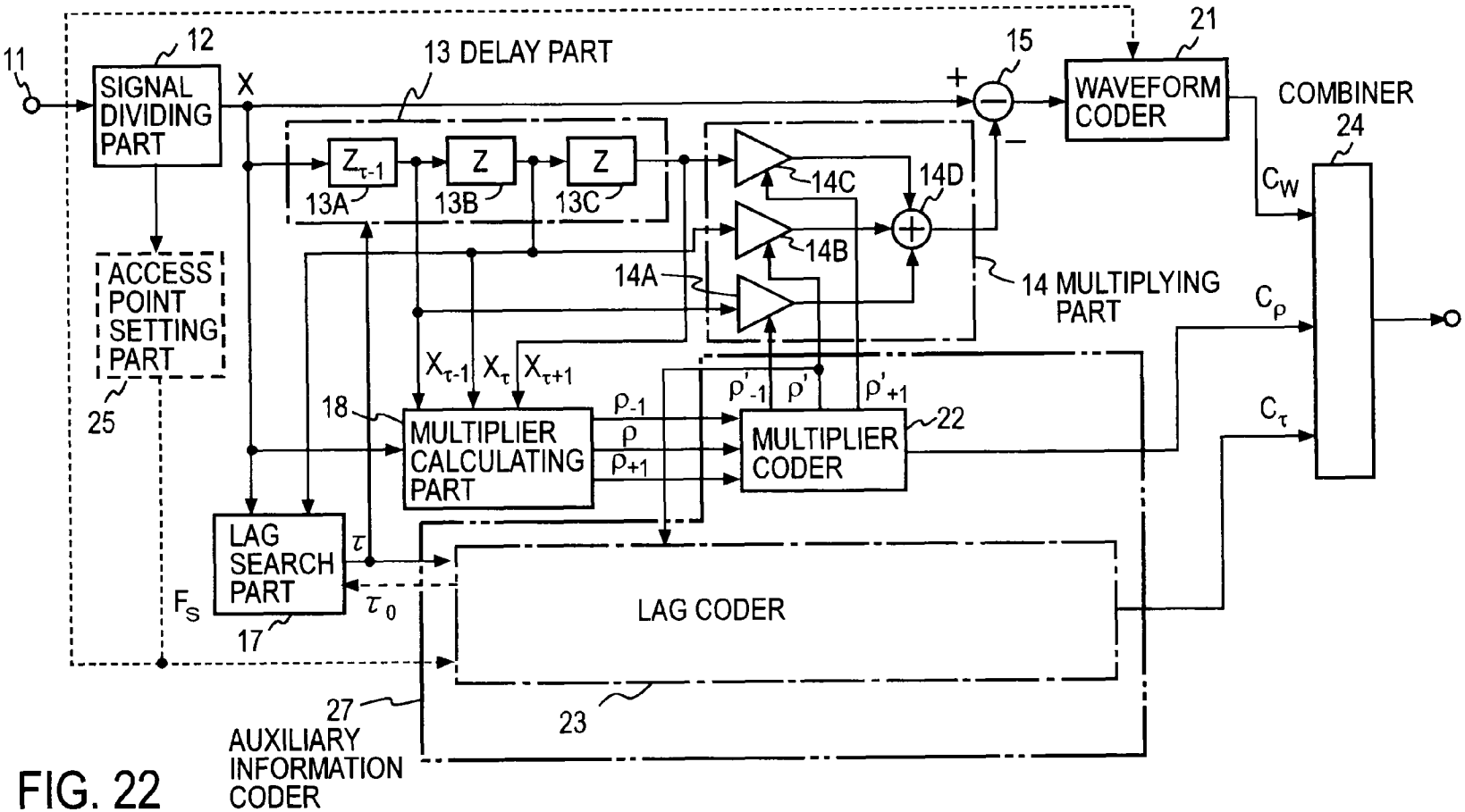
FIG. 22 is a block diagram showing a configuration of a coding apparatus designed to use multiple delay taps.

In the embodiments described above, a prediction signal $\rho' X_\tau$ for a signal X is generated by multiplying a signal $X_\tau$ of each time lag $\tau$ (i.e., one delay tap) by one multiplier $\rho'$ as illustrated in FIG. 3, but a prediction signal may be generated based on signals of a time lag $\tau$ and multiple adjacent time lags. A configuration of a coding apparatus used for that is shown in FIG. 22. In the configuration FIG. 22, there are three delay taps and the delay part 13 in FIG. 1 is replaced with a $\tau-1$ sample delay part ($Z_{\tau-1}$) 13A and two unit delay parts 13B and 13C which are connected in series. The delay part 13 sets a delay of $\tau-1$ samples in the delay part 13A with respect to the time lag $\tau$ provided by the lag search part 17. Thus, with respect to the input signal X, the delay parts 13A, 13B, and 13C output a signal $X_{\tau-1}$ delayed by $\tau-1$ samples, a signal $X_\tau$ delayed by $\tau$ samples, and a signal $X_{\tau+1}$ delayed by $\tau+1$ samples, respectively.

The multiplying part 14 consists of multiplying devices 14A, 14B, and 14C and an adder 14D which adds their outputs and gives the result of addition to the subtractor 15 as a prediction signal. The multiplier calculating part 18 calculates three optimum multipliers $\rho_{-1}$, $\rho$, and $\rho_{+1}$ for the three delay taps using the input signal and delayed signals $X_{\tau-1}$, $X_{\tau}$, and $X_{\tau+1}$ as described later and gives them to the multiplier coder 22. The multiplier coder 22 codes the three multipliers $\rho_{-1}$, $\rho$, and $\rho_{+1}$ together and outputs a multiplier code $C_{\rho}$. Also, it gives quantized multipliers $\rho_{-1}'$, $\rho'$, $\rho_{-1}'$ resulting from the coding to the multiplying devices 14A, 14B, and 14C of the multiplier calculating part 18. Also, it gives the quantized multiplier $\rho'$ to the determination part 31*a* of the coding selector 31.

The multiplier calculating part 18 calculates multipliers as follows.

The multipliers for signals of the three delay taps are determined in such a way as to minimize distortion d in the following equation.

$$d = \sum_{i=0}^{N-2} \left( x(i) - \sum_{j=-1}^{1} \rho_j x(i-\tau-j) \right)^2 \tag{6}$$

Such multipliers $\rho_{-1}$, $\rho$, and $\rho_{+1}$ can be calculated using the following equation.

$$\begin{bmatrix} \rho_{-1} \\ \rho \\ \rho_{+1} \end{bmatrix} = \begin{bmatrix} X_{\tau-1}^T X_{\tau-1} & X_{\tau-1}^T X_{\tau} & X_{\tau-1}^T X_{\tau+1} \\ X_{\tau}^T X_{\tau-1} & X_{\tau}^T X_{\tau} & X_{\tau}^T X_{\tau+1} \\ X_{\tau+1}^T X_{\tau-1} & X_{\tau+1}^T X_{\tau} & X_{\tau+1}^T X_{\tau+1} \end{bmatrix} \begin{bmatrix} X_{\tau-1}^T X \\ X_{\tau}^T X \\ X_{\tau+1}^T X \end{bmatrix} \tag{7}$$

In this way, the use of signals from multiple delay taps in generating a prediction signal, makes it possible to increase prediction accuracy, reduce energy of the error signal obtained by the subtractor 15, and provide more efficient coding. Although three delay taps are used in FIG. 22, this is not restrictive and any desired number of taps may be used.

Figure 23:
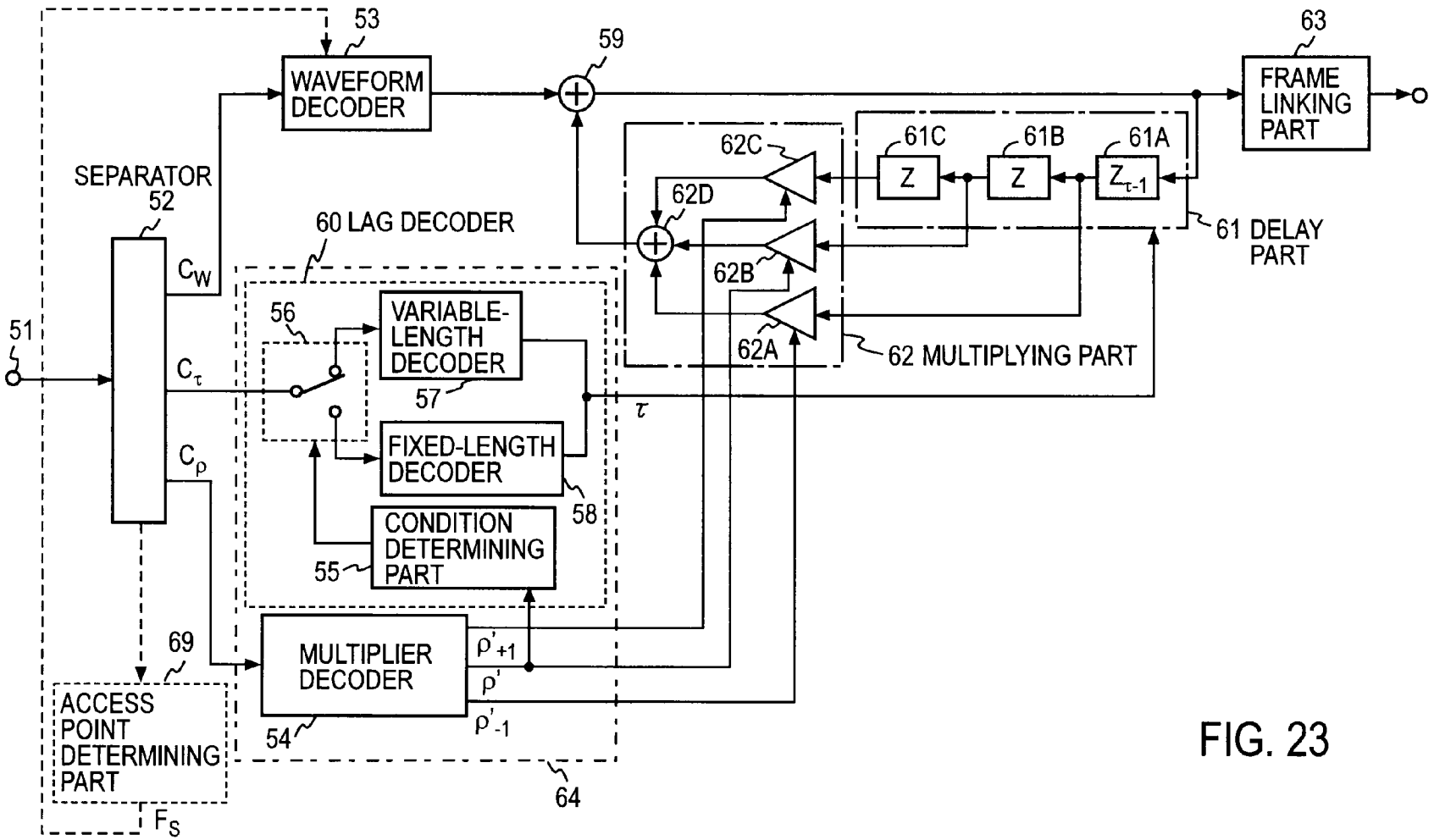
FIG. 23 is a block diagram showing a configuration of a decoding apparatus which corresponds to the coding apparatus in FIG. 22.

FIG. 23 shows a configuration example of a decoding apparatus which corresponds to the coding apparatus in FIG. 22. In this configuration, a delay part 61 consists of a $\tau-1$ sample delay part 61A and two unit delay parts 61B and 61C which are connected in series as in the case of the delay part 13 in FIG. 22 while a multiplying part 62 consists of three multiplying devices 62A, 62B, and 62C, and an adder 62D as in the case of the multiplying part 14 in FIG. 22. The multiplier code $C_{\rho}$ from the separator 52 is decoded into the three quantized multipliers $\rho_{-1}'$, $\rho'$, and $\rho_{+1}'$ by the multiplier decoder 54. The quantized multipliers are given to the multiplying devices 62A, 62B, and 62C, respectively, and multiplied by the outputs from the delay parts 61A, 61B, and 61C, respectively. The results of multiplication are added by the adder 62D and the result of addition is given to the adder 59 as a prediction signal. The quantized multiplier $\rho'$ is also given to the condition determining part 55 and used for selection between decoders 57 and 58 in decoding the lag code $C_{\tau}$. The rest of the configuration and operation is the same as in FIG. 6.

Fifth Embodiment

Description will be given of a fifth embodiment in which a frame is coded after being divided into four sub-frames. In this case, there are four possible methods for outputting parameters of a quantized multiplier $\rho'$ and time lag $\tau$ as follows.

(1) To output $\rho'$ and $\tau$ once in the frame.

(2) To output the quantized multiplier $\rho'$ in each sub-frame.

(3) To output the time lag $\tau$ in each sub-frame.

(4) To output $\rho'$ and $\tau$ in each sub-frame.

Figure 24:
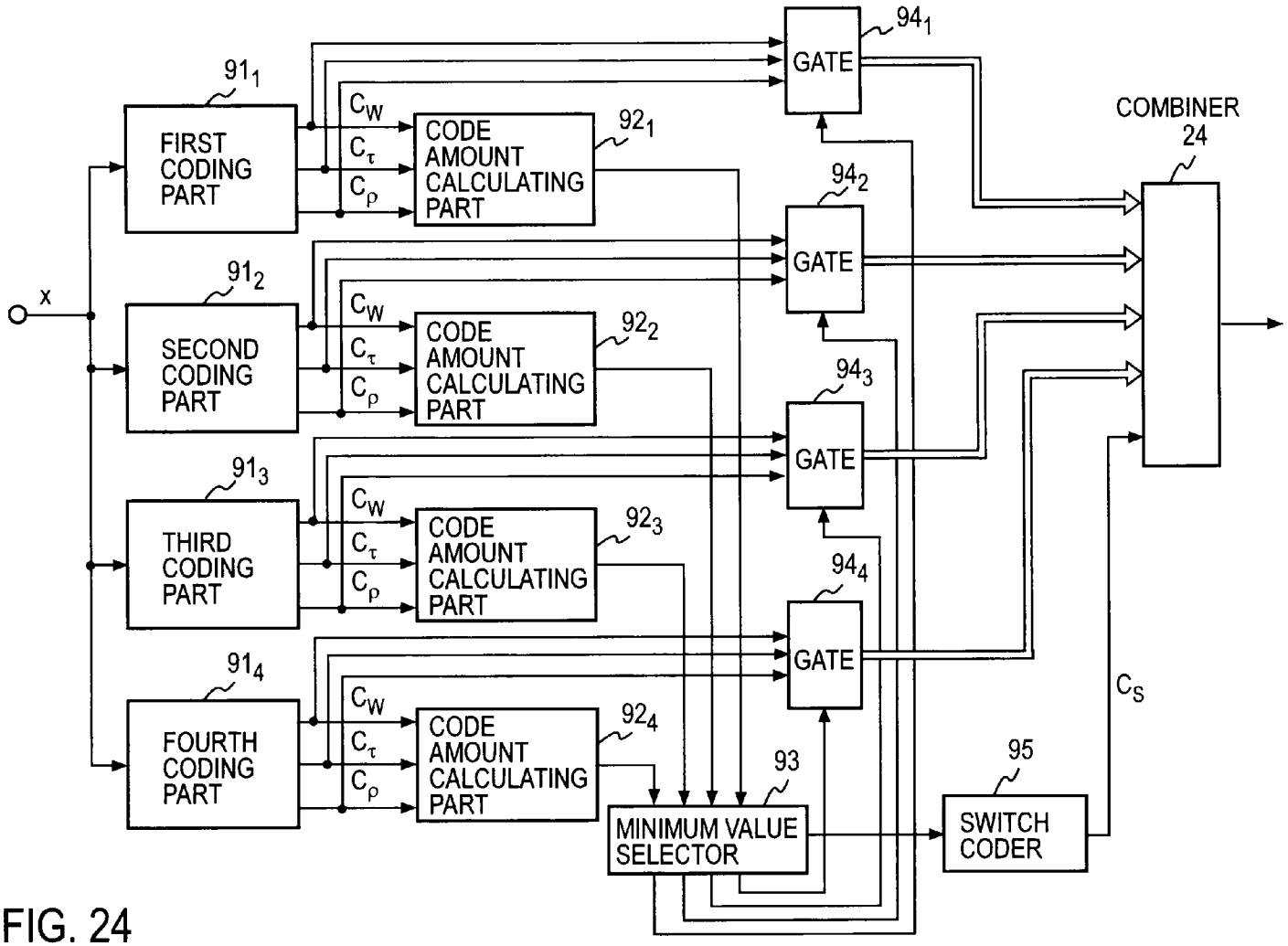
FIG. 24 is a block diagram showing an example of a functional configuration of a coding apparatus according to a fifth embodiment.

In any of the above cases, the parameters are outputted in coded form. Information as to which of the four methods has been selected is encoded into a switch code, and the combination of the switch code, auxiliary code, and waveform code $C_W$ which minimizes the amount of codes or coding distortion is selected for each frame. As shown in FIG. 24 in a simple manner, the input signal x is assigned a code by first to fourth coding parts $\mathbf{91}_1$ to $\mathbf{91}_4$ which correspond to the four methods (1) to (4), respectively. Output codes $C_W$, $C_{\tau}$, and $C_{\rho}$ from the first to fourth coding parts $\mathbf{91}_1$ to $\mathbf{91}_4$ are inputted to code amount calculating parts $\mathbf{92}_1$ to $\mathbf{92}_4$, each of which calculates the total code amount of the output signals. The minimum value of the calculated total amounts of codes is selected by a minimum value selector 93. Gates $\mathbf{94}_1$ to $\mathbf{94}_4$ corresponding to the first to fourth coding parts $\mathbf{91}_1$ to $\mathbf{91}_4$ are installed, the gate corresponding to the minimum value selected by the minimum value selector 93 is opened, the codes $C_W$, $C_{\tau}$, and $C_{\rho}$ from the coding part corresponding to the gate are inputted to the combiner 24. Also, a signal indicating which of the first to fourth coding parts $\mathbf{91}_1$ to $\mathbf{91}_4$ has been selected by the minimum value selector 93 is coded by a switch coder 95 and inputted to the combiner 24 as a switch code $C_S$.

When outputting a parameter in each sub-frame, the parameter may be coded based on its value in the previous sub-frame or, for example, four parameters may be compressed together using an arithmetic code which reflects a conjunction frequency. For example, a table of relationship between the products of concurrence frequencies of the four parameters and the four parameters may be used with smaller codewords representing smaller frequency differences. Out of possibilities (1) to (4), for example, only (1), (2), and (4), or only (1) and (4) may be used. Also, the number of sub-frames is not limited to four, and the use of either four sub-frames or eight sub-frames whichever is preferable may be selected.

Although in the first and second embodiments, the coding method of the time lag $\tau$ or multiplier $\rho$ is changed depending on the multiplier, it is alternatively possible, for example, that the time lag $\tau$ is fixed-length coded (as described in the first embodiment) and also variable-length coded, amounts of code including the waveform code $C_W$ in both cases are calculated, and the code with the smaller amount of codes is outputted together with a switch code (which may be one bit long) indicating which coding method has been selected. Regarding the coding of the multiplier, the code may be outputted together with a switch code by similarly selecting between two predetermined coding methods.

In short, according to the present invention, the relationship between the time lag $\tau$ or multiplier $\rho$ and codewords is switched depending on the quantized multiplier $\rho'$ or using a switch code, i.e., adaptively. Similarly, on the decoding side, the relationship between the time lag $\tau$ or quantized multiplier $\rho'$ and codeword is switched adaptively based on decoded information.

Figure 25:
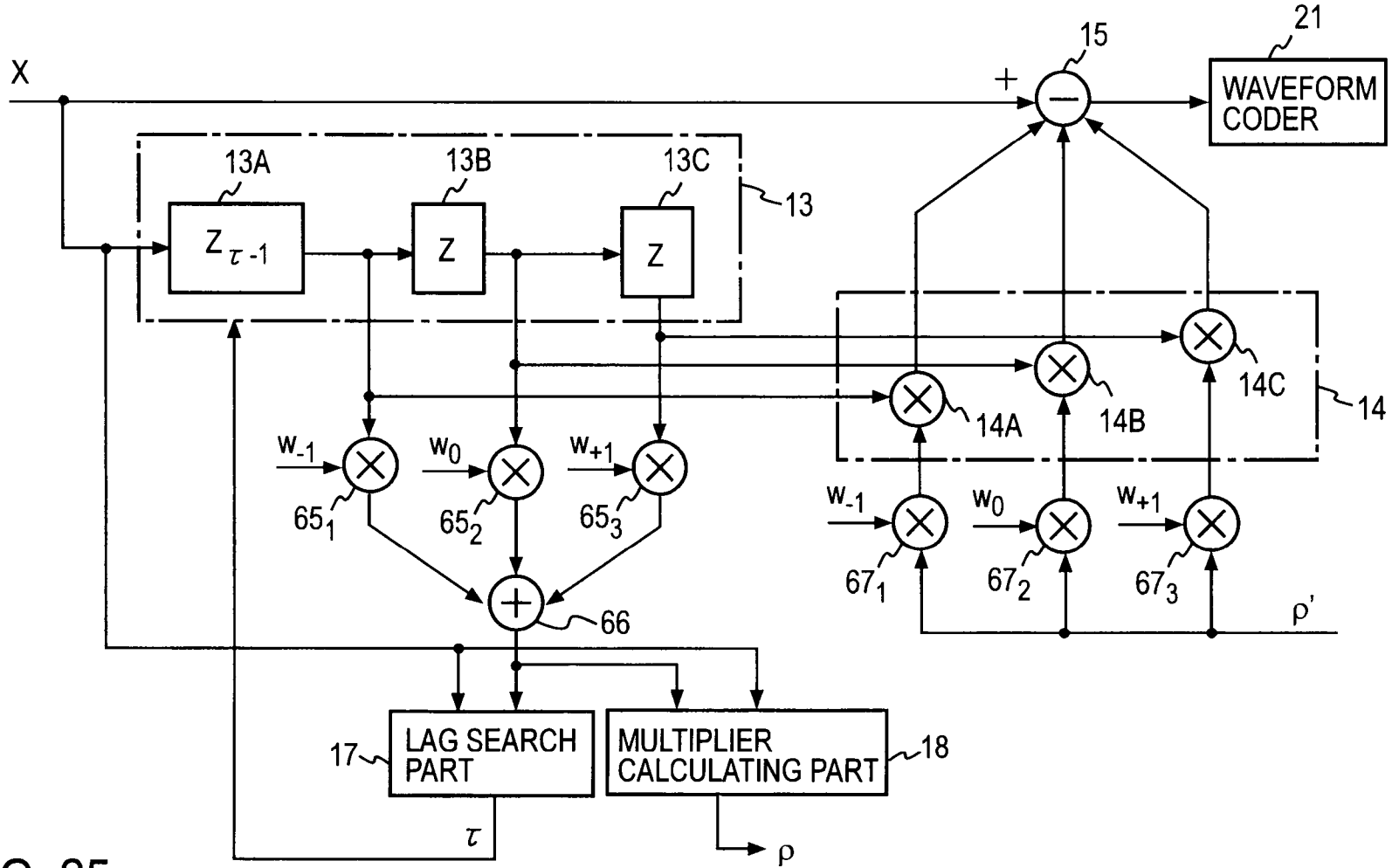
FIG. 25 is a block diagram showing an example of a functional configuration of the essential parts of a coding apparatus to which the present invention is applied and which generates a long-term prediction signal based on multiple samples.

Regarding a long-term prediction signal, it may be generated through weighted addition of multiple delayed samples. A functional configuration example of the essence of a coding apparatus used for that is shown in FIG. 25. Three samples are used in this example. An input time-series signal X divided into frames is delayed $\tau-1$ samples by the delay part 13A and further delayed one frame each by the unit delay parts 13B and 13C successively. Outputs of the delay parts 13A, 13B, and 13C are multiplied by respective predetermined weights, for example, $w_{-1}=0.25$, $w_0=0.5$, $w_t=0.25$ by multiplying parts $\mathbf{65}_1$, $\mathbf{65}_2$, and $\mathbf{65}_3$ and the results of multiplication are added by an adder 66 and inputted to the lag search part 17. The lag search part 17 processes the result of addition produced by the adder 66, as an input $X_\tau$ of the lag search part 17 in FIG. 1.

The quantized multiplier ρ' from the multiplier coder 22 in FIG. 1 is multiplied by respective weights $w_{-1}$, $w_0$, and $w_{+1}$ by multiplying parts $\mathbf{67}_1$, $\mathbf{67}_2$, and $\mathbf{67}_3$, respectively, and the results of multiplication are multiplied by the samples outputted from the delay parts 13A, 13B, and 13C by the multiplying devices 14A, 14B, and 14C, respectively. The sum of the outputs from the multiplying devices 14A, 14B, and 14C are subtracted as a long-term prediction signal from the input time-series signal X by the subtractor 15.

Figure 26:
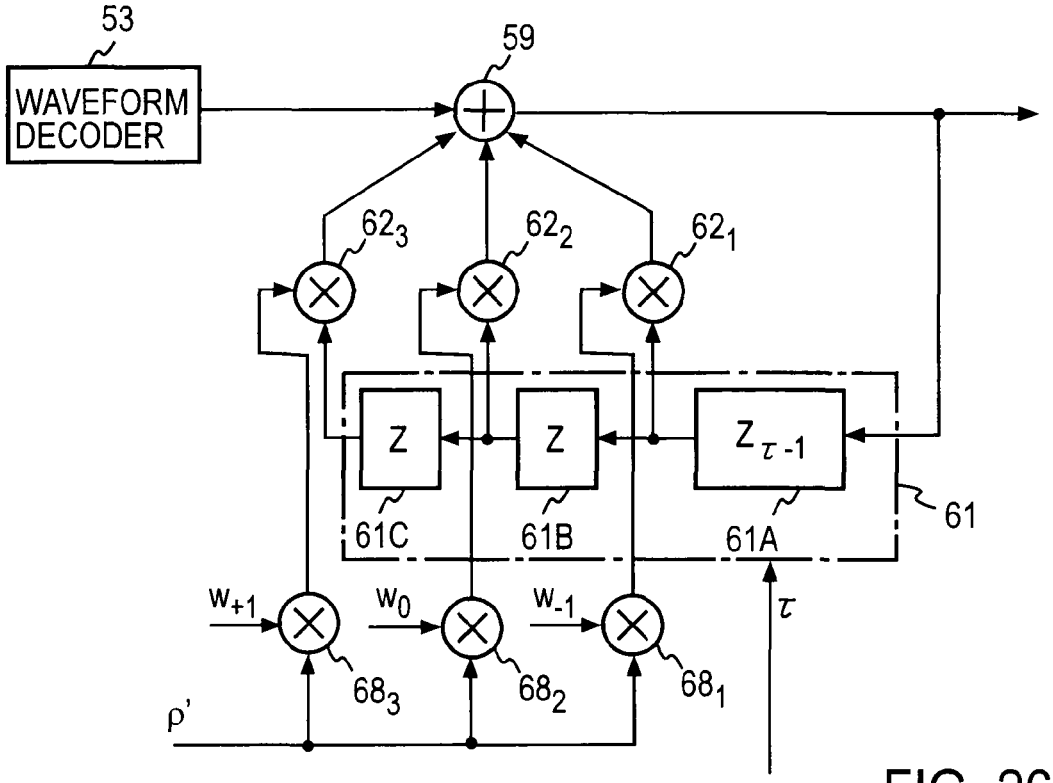
FIG. 26 is a block diagram showing an example of a functional configuration of the essential parts of a decoding apparatus which corresponds to the coding apparatus in FIG. 25.

A functional configuration example of the essence of a decoding apparatus used here is shown in FIG. 26. The decoded quantized multiplier ρ' from the multiplier decoder 54 is multiplied by respective weights $w_{-1}$, $w_0$, and $w_{+1}$ by multiplying parts $\mathbf{68}_1$, $\mathbf{68}_2$, and $\mathbf{68}_3$, respectively. The decoded time-series signal from the adder 59 is delayed τ−1 samples (τ is received from the lag decoder 60) by the τ−1 sample delay part 61A of the delay part 61 and further delayed one frame each by the unit delay parts 61B and 61C of the delay part 61 successively. The outputs of the delay parts 61A, 61B, and 61C are multiplied by the multiplication results of the multiplying parts $\mathbf{68}_1$, $\mathbf{68}_2$, and $\mathbf{68}_3$, respectively, by multiplying parts $\mathbf{62}_1$, $\mathbf{62}_2$, and $\mathbf{62}_3$. The sum of the outputs from the multiplying parts $\mathbf{62}_1$, $\mathbf{62}_2$, and $\mathbf{62}_3$ are added as a decoded long-term prediction signal to a decoded error signal from the waveform decoder 53 by the adder 59.

Single-channel signals have been described so far, but a long-term prediction signal can be generated from another channel in coding of multi-channel signals. That is, ρ and τ may be generated using a signal on another channel, where coding and decoding of ρ and τ are the same as those described above. However, single-channel decoding differs from multi-channel decoding in that a signal sometimes refers regressively to past samples of the signal itself within the same frame.

A computer can be made to function as any of the coding apparatus and decoding apparatus described in the above embodiments. In that case, a program for use to make the computer function as each of the apparatus can be installed on the computer from a recording medium such as a CD-ROM, magnetic disk, or semiconductor recording device or downloaded onto the computer via a communications line. Then, the computer can be made to execute the program.

What is claimed is:

1. A long-term prediction coding method implemented on a coding apparatus that includes a processor, in which an error signal sample is obtained by subtracting from a current sample of an input sample time-series signal a multiplication result obtained by multiplying a past sample which is a predetermined time lag older than the current sample of the input sample time-series signal, by a multiplier, the method comprising:

(a) a step of selecting, at the coding apparatus, for each frame, one of at least two predetermined methods of the following four methods:

(1) producing, at the coding apparatus, codes of a multiplier and a time lag once for the frame;

(2) producing, at the coding apparatus, a code of a multiplier for each of plural sub-frames into which the frame is divided;

(3) producing, at the coding apparatus, a code of a time lag for each of plural sub-frames into which the frame is divided; and (4) producing, at the coding apparatus, codes of a multiplier and a time lag for each of plural sub-frames into which the frame is divided;

that minimizes a total amount of codes or coding distortion of a combination of a selection code representing the selected one of the four methods, an auxiliary code obtained by coding the time lag and the multiplier and a waveform code obtained by coding the error signal sample; and (b) a step of outputting, at the coding apparatus, the combination of the selection code, the auxiliary code and the waveform code.

2. A long-term prediction coding method implemented on a coding apparatus that includes a processor, in which an error signal sample is obtained by subtracting from a current sample of an input sample time-series signal a multiplication result obtained by multiplying a past sample which is a predetermined time lag older than the current sample of the input sample time-series signal, by a multiplier, the method comprising:

(a) a step of selecting, at the coding apparatus, for each frame, one of the following two methods:

(1) producing, at the coding apparatus, codes of a multiplier and a time lag once for the frame; and (2) producing, at the coding apparatus, codes of a multiplier and a time lag for each of plural sub-frames into which the frame is divided;

that minimizes a total amount of codes or coding distortion of a combination of a selection code representing the selected one of the two methods, an auxiliary code obtained by coding the time lag and the multiplier and a waveform code obtained by coding the error signal sample; and (b) a step of outputting, at the coding apparatus, the combination of the selection code, the auxiliary code and the waveform code.

3. A long-term prediction decoding method implemented on a decoding apparatus that includes a processor, in which a sample of reconstructed time-series signal is obtained by adding a current sample of an error signal to a multiplication result obtained by multiplying a past sample of the reconstructed time-series signal which is the time lag older, by a multiplier, the method comprising:

(a) a step of decoding, at the decoding apparatus, for each frame, a time lag and a multiplier from an auxiliary code based on a selection code representing one of at least two predetermined methods of the following four methods:

(1) decoding, at the decoding apparatus, of a multiplier and a time lag once for the frame;

(2) decoding, at the decoding apparatus, of a multiplier for each of plural sub-frames into which the frame is divided;

(3) decoding, at the decoding apparatus, of a time lag for each of plural sub-frames into which the frame is divided; and (4) decoding, at the decoding apparatus, of a multiplier and a time lag for each of plural sub-frames into which the frame is divided.

4. A long-term prediction decoding method implemented on a decoding apparatus that includes a processor, in which a sample of reconstructed time-series signal is obtained by adding a current sample of an error signal to a multiplication result obtained by multiplying a past sample of the reconstructed time-series signal which is the time lag older, by a multiplier, the method comprising:

(a) a step of decoding, at the decoding apparatus, for each frame, a time lag and a multiplier from an auxiliary code based on a selection code representing one of the following two methods:

(1) decoding, at the decoding apparatus, of a multiplier and a time lag once for the frame; and (2) decoding, at the decoding apparatus, of a multiplier and a time lag for each of plural sub-frames into which the frame is divided.

5. A long-term prediction coding apparatus in which an error signal sample is obtained by subtracting from a current sample of an input sample time-series signal a multiplication result obtained by multiplying a past sample which is a predetermined time lag older than the current sample of the input sample time-series signal, by a multiplier, the apparatus comprising:

a processor;

a minimum value selector, implemented by the processor, for selecting, for each frame, one of at least two predetermined methods of the following four methods:

(1) producing codes of a multiplier and a time lag once for the frame;

(2) producing a code of a multiplier for each of plural sub-frames into which the frame is divided;

(3) producing a code of a time lag for each of plural sub-frames into which the frame is divided; and (4) producing codes of a multiplier and a time lag for each of plural sub-frames into which the frame is divided; and that minimizes a total amount of codes or coding distortion of a combination of a selection code representing the selected one of the four methods, an auxiliary code obtained by coding the time lag and the multiplier and a waveform code obtained by coding the error signal sample; and a combiner for outputting the combination of the selection code, the auxiliary code and the waveform code.

6. A long-term prediction coding apparatus in which an error signal sample is obtained by subtracting from a current sample of an input sample time-series signal a multiplication result obtained by multiplying a past sample which is a predetermined time lag older than the current sample of the input sample time-series signal, by a multiplier, the apparatus comprising:

a processor;

a minimum value selector, implemented by the processor, for selecting, for each frame, one of the following two methods:

(1) producing codes of a multiplier and a time lag once for the frame; and (2) producing codes of a multiplier and a time lag for each of plural sub-frames into which the frame is divided;

that minimizes a total amount of codes or coding distortion of a combination of a selection code representing the selected one of the two methods, an auxiliary code obtained by coding the time lag and the multiplier and a waveform code obtained by coding the error signal sample; and a combiner for outputting the combination of the selection code, the auxiliary code and the waveform code.

7. A long-term prediction decoding apparatus in which a sample of reconstructed time-series signal is obtained by adding a current sample of an error signal to a multiplication result obtained by multiplying a past sample of the reconstructed time-series signal which is the time lag older, by a multiplier, the apparatus comprising:

a processor;

decoding part, implemented by the processor, for decoding, for each frame, a time lag and a multiplier from an auxiliary code based on a selection code representing one of at least two predetermined methods of the following four methods:

(1) decoding of a multiplier and a time lag once for the frame;

(2) decoding of a multiplier for each of plural sub-frames into which the frame is divided;

(3) decoding of a time lag for each of plural sub-frames into which the frame is divided; and (4) decoding of a multiplier and a time lag for each of plural sub-frames into which the frame is divided.

8. A long-term prediction decoding apparatus in which a sample of reconstructed time-series signal is obtained by adding a current sample of an error signal to a multiplication result obtained by multiplying a past sample of the reconstructed time-series signal which is the time lag older, by a multiplier, the apparatus comprising:

a processor;

decoding part, implemented by the processor, for decoding, for each frame, a time lag and a multiplier from an auxiliary code based on a selection code representing one of the following two methods:

(1) decoding of a multiplier and a time lag once for the frame; and (2) decoding of a multiplier and a time lag for each of plural sub-frames into which the frame is divided.

* * * * *